US012723774B2

(12) United States Patent
Komatsu et al.

(10) Patent No.: US 12,723,774 B2
(45) Date of Patent: Sep. 1, 2026

(54) BLOW-OUT UNIT AND AIR CONDITIONING APPARATUS

(71) Applicant: DAIKIN INDUSTRIES, LTD., Osaka (JP)

(72) Inventors: Akira Komatsu, Osaka (JP); Kentarou Niki, Osaka (JP); Shuuichi Tanaka, Osaka (JP); Tooru Fujimoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 518 days.

(21) Appl. No.: 18/099,706

(22) Filed: Jan. 20, 2023

(65) Prior Publication Data

US 2023/0151999 A1 May 18, 2023

Related U.S. Application Data

(63) Continuation of application No. PCT/JP2021/026805, filed on Jul. 16, 2021.

(30) Foreign Application Priority Data

Jul. 22, 2020 (JP) ..... 2020-125664
Jul. 22, 2020 (JP) ..... 2020-125665

(51) Int. Cl.
*F24F 13/08* (2006.01)
*F24F 13/14* (2006.01)

(52) U.S. Cl.
CPC ..... *F24F 13/082* (2013.01); *F24F 13/14* (2013.01)

(58) Field of Classification Search
CPC ..... F24F 13/14; F24F 13/082; F24F 13/075
See application file for complete search history.

(56) References Cited

U.S. PATENT DOCUMENTS 3,126,811 A 3/1964 Kennedy
4,677,904 A 7/1987 Natsumeda et al.
(Continued)

FOREIGN PATENT DOCUMENTS

CN 105240941 A 1/2016
JP S51-25853 U 2/1976
(Continued)

OTHER PUBLICATIONS

International Search Report issued in corresponding International Application No. PCT/JP2021/026805 mailed Sep. 21, 2021 (5 pages).
(Continued)

*Primary Examiner* — Allen R. B. Schult
(74) *Attorney, Agent, or Firm* — Osha Bergman Watanabe & Burton LLP

(57) ABSTRACT

A blow-out unit disposed at a blow-out port on an air flow path and configured to blow out air supplied through the air flow path, toward the room, includes: a first member disposed in the blow-out port and including a plate member having a first side and configured to turn around a rotating shaft disposed away from the first side such that the first side moves away from the blow-out port toward the air flow path; and a second member disposed in the blow-out port at a different position from the plate member and extending along the first side of the plate member. The plate member and the second member change a direction of air to be blown out toward the blow-out port through the air flow path from a first air flow direction to a second air flow direction.

16 Claims, 20 Drawing Sheets

(56) References Cited

U.S. PATENT DOCUMENTS

| | | | |
|---|---|---|---|
| 2009/0241576 | A1 | 10/2009 | Tsuji et al. |
| 2013/0167578 | A1 | 7/2013 | Ikeda et al. |
| 2014/0302769 | A1 | 10/2014 | Sawada |
| 2017/0146248 | A1 | 5/2017 | Yamaguchi |

FOREIGN PATENT DOCUMENTS

| | | | | | |
|---|---|---|---|---|---|
| JP | 3025631 | U | | 6/1996 | |
| JP | 08313040 | A | * | 11/1996 | |
| JP | 3040546 | U | | 8/1997 | |
| JP | 2007-155309 | A | | 6/2007 | |
| JP | 2017-72295 | A | | 4/2017 | |
| KR | 20190068044 | A | * | 6/2019 | ..... F24F 13/075 |
| WO | 2012046438 | A1 | | 4/2012 | |

OTHER PUBLICATIONS

International Preliminary Report on Patentability issued in International Application No. PCT/JP2021/026805; issued Jan. 24, 2023 (6 pages).

Extended European Search Report issued in corresponding European Patent Application No. 21847318.9, dated Dec. 7, 2023 (7 pages).

Extended European Search Report issued in related European Application No. 25213562.9 dated Feb. 12, 2026 (9 pages).

* cited by examiner

BLOW-OUT UNIT AND AIR CONDITIONING APPARATUS

CROSS-REFERENCE TO RELATED APPLICATIONS

This is a continuation application of International Patent Application No. PCT/JP2021/026805, filed on Jul. 16, 2021, and claims priority to Japanese Patent Application No. 2020-125664, filed on Jul. 22, 2020 and priority to Japanese Patent Application No. 2020-125665, filed on Jul. 22, 2020. The contents of these priority applications are incorporated herein by reference.

TECHNICAL FIELD

The present disclosure relates to a blow-out unit placed at a blow-out port of an air flow path through which air is blown out toward a room, the blow-out unit configured to blow out, toward the room, air supplied thereto through the air flow path.

BACKGROUND

Patent Literature 1 (JP 2007-155309 A) discloses an air flow direction adjustment flap disposed at an air blow-out port of an air conditioner. According to Patent Literature 1, the air flow direction adjustment flap can be subjected to an angular adjustment relative to a rotating shaft, and is connected to an air flow direction adjusting motor to be controlled for adjusting an air blow-out direction.

According to Patent Literature 1, the rotating shaft of the air flow direction adjustment flap is located at a center of the air flow direction adjustment flap as seen in a section taken along a direction perpendicular to a direction along which the rotating shaft extends. This configuration is less likely to achieve an accurate air flow direction adjustment since air is disadvantageously blown out through gaps formed near two ends of the air flow direction adjustment flap, as seen in the section, when the air flow direction adjustment flap turns.

SUMMARY

One or more embodiments of the present disclosure provide a blow-out port with improved degree of freedom as to an air flow direction adjustment, with a simple structure.

A blow-out unit according to the present disclosure is a blow-out unit placed at a blow-out port of an air flow path through which air is blown out toward a room, the blow-out unit configured to blow out, toward the room, air supplied thereto through the air flow path. The blow-out unit includes a first member and a second member each placed in the blow-out port. The first member is a plate member. The plate member includes a first side and is configured to turn on a rotating shaft located away from the first side so that the first side moves away from the blow-out port toward the air flow path. The second member is different in placement position from the plate member in the blow-out port, and extends along the first side of the plate member. The plate member and the second member change a first air flow direction of air to be blown out toward the blow-out port through the air flow path, to a second air flow direction. The plate member turns to change the second air flow direction.

BRIEF DESCRIPTION OF THE DRAWINGS

FIG. 4 also illustrates geometric parameters of the blow-out unit 1.

FIG. 7C also illustrates blow-out ports P1 and P2 which are open.

FIG. 10 also illustrates four blow-out ports which are open.

FIG. 13A also illustrates a first plate member 10 and a second plate member 20 which are in a first state.

FIG. 13B also illustrates the first plate member 10 and the second plate member 20 which are in a second state.

FIG. 14A illustrates a case where the blow distance D1 is long.

FIG. 14B illustrates a case where the blow distance D1 is medium.

FIG. 14C illustrates a case where the blow distance D1 is short.

FIG. 15A illustrates a case where an air current angle is 20° relative to the horizontal.

FIG. 15B illustrates a case where the air current angle is 30° relative to the horizontal.

FIG. 15C illustrates a case where the air current angle is 45° relative to the horizontal.

FIG. 15D illustrates a case where the air current angle is 65° relative to the horizontal.

FIG. 15E illustrates a case where the air current angle is 90° relative to the horizontal.

DETAILED DESCRIPTION

First Embodiments (1) Configuration of Blow-Out Unit 1

A blow-out unit 1 is placed at a blow-out port P of an air flow path S through which air is blown out toward a room 3, and is configured to blow out, toward the room 3, air supplied thereto through the air flow path S. As used herein, air to be supplied to the blow-out unit 1 involves, for example, outside air or indoor air to be blown out as it is, and outside air or indoor air that is heated, cooled, dehumidified, or humidified. The blow-out port P is bored in a ceiling or a wall of the room. The blow-out unit 1 is located nearer to the air flow path S than to the blow-out port P and is placed on an attic or behind a sidewall.

Figure 1:
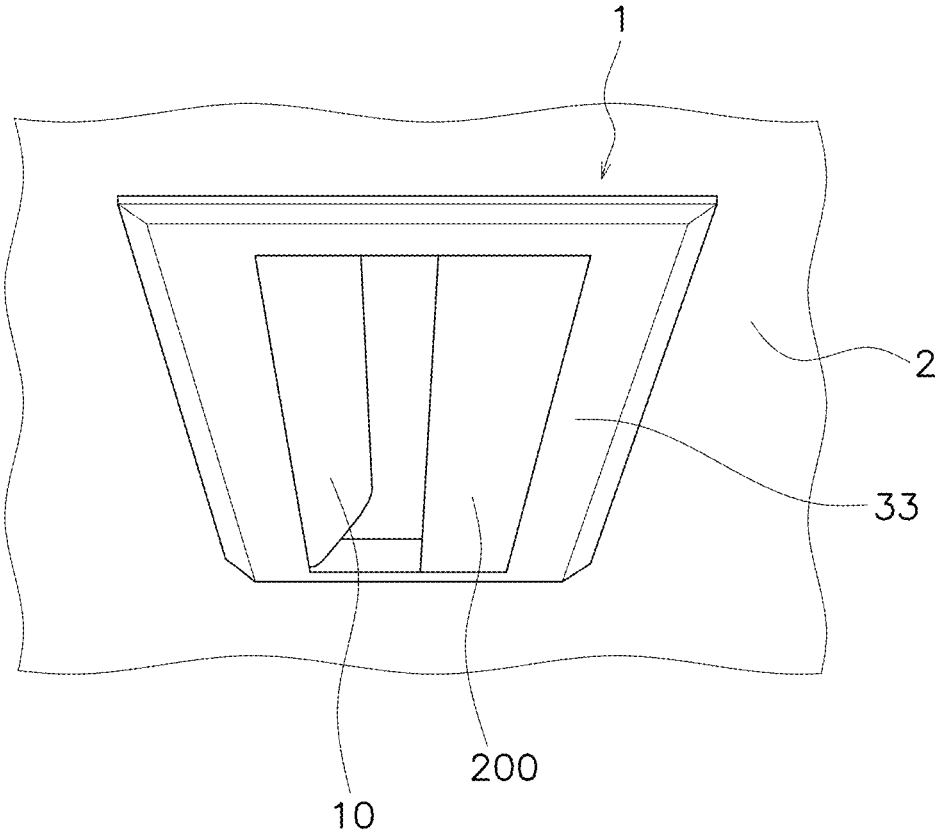
FIG. 1 is a perspective view illustrating a blow-out unit 1 according to first embodiments together with a ceiling, the blow-out unit 1 seen from below.
Figure 2A:
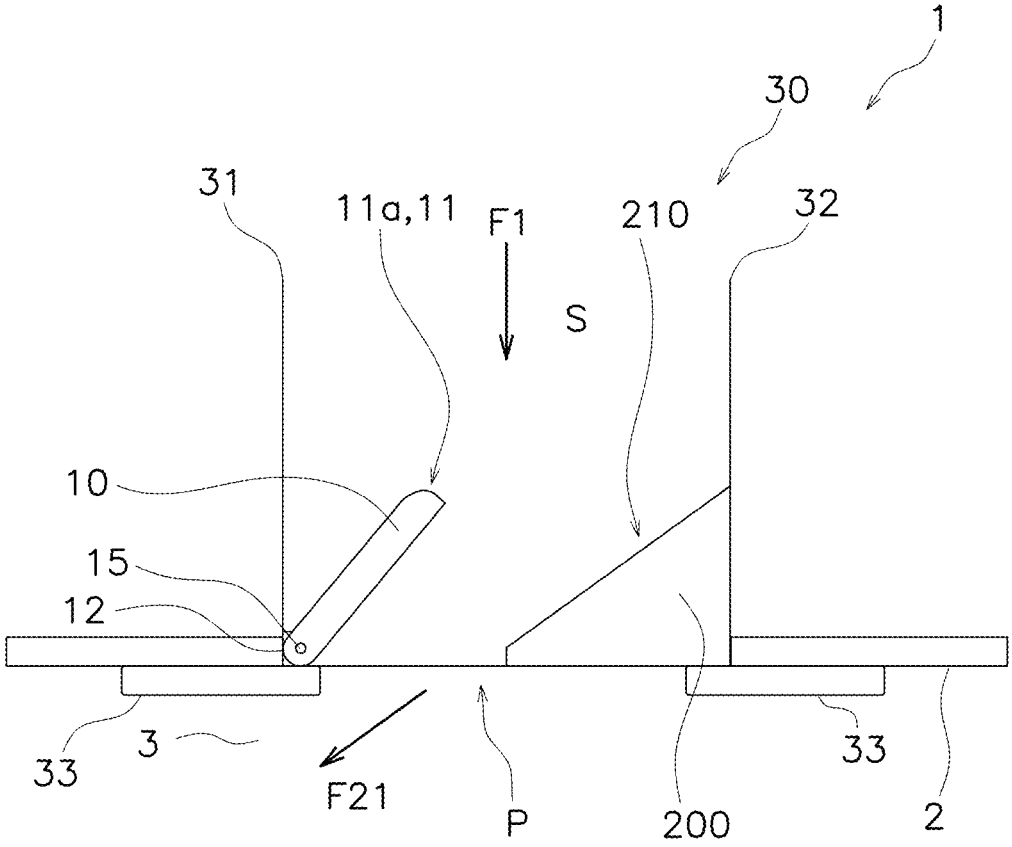
FIG. 2A is a vertical sectional view illustrating the blow-out unit 1 according to the first embodiments in a state in which a turning angle of a plate member 10 of the blow-out unit 1 is 45° relative to the horizontal.
Figure 2B:
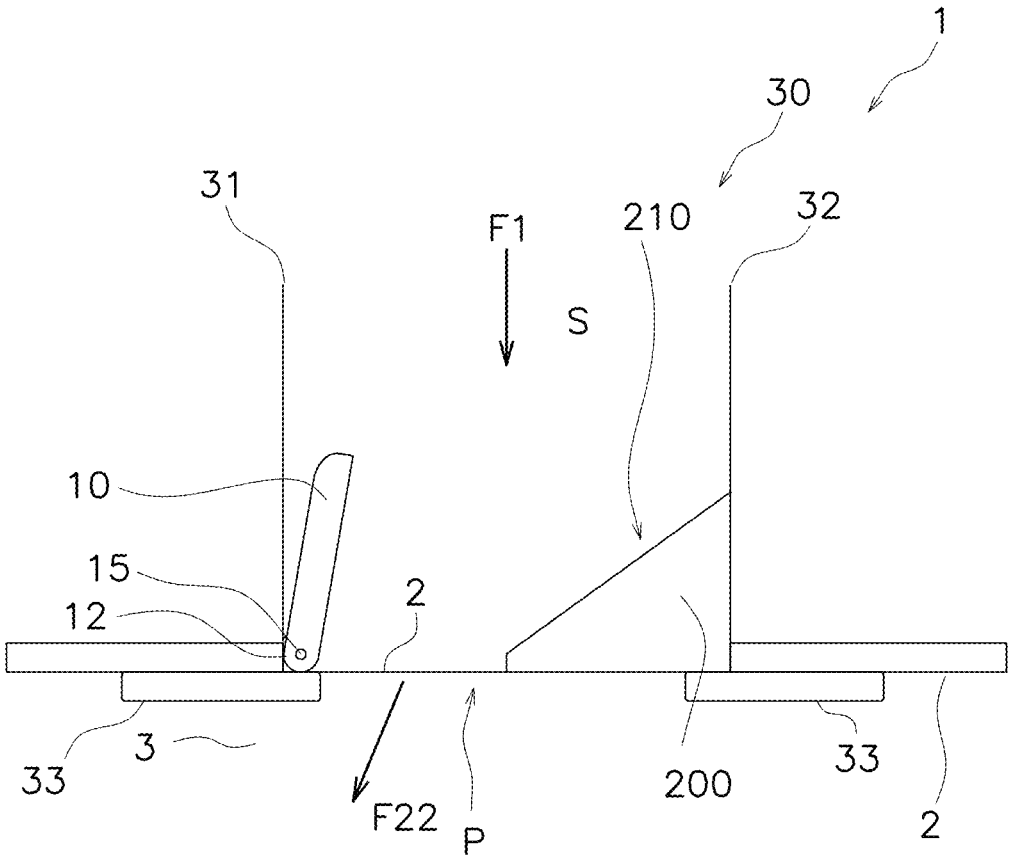
FIG. 2B is a vertical sectional view illustrating the blow-out unit 1 according to the first embodiments in a state in which the turning angle of the plate member 10 of the blow-out unit 1 is 80° relative to the horizontal.
Figure 3A:
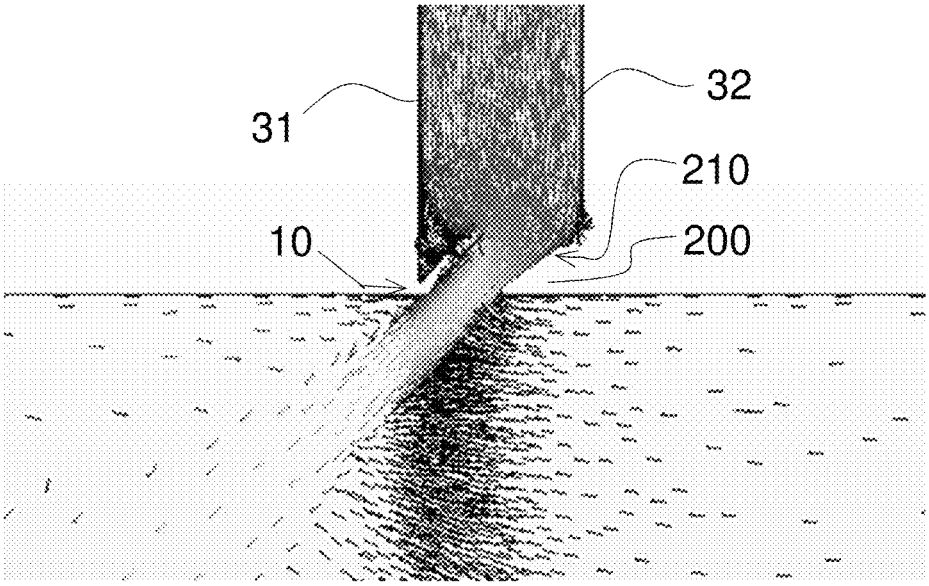
FIG. 3A is a diagram illustrating a result of a simulation performed as to an air flow direction of air blown out by the blow-out unit 1 according to the first embodiments in the state in which the turning angle of the plate member 10 is 45° relative to the horizontal.
Figure 3B:
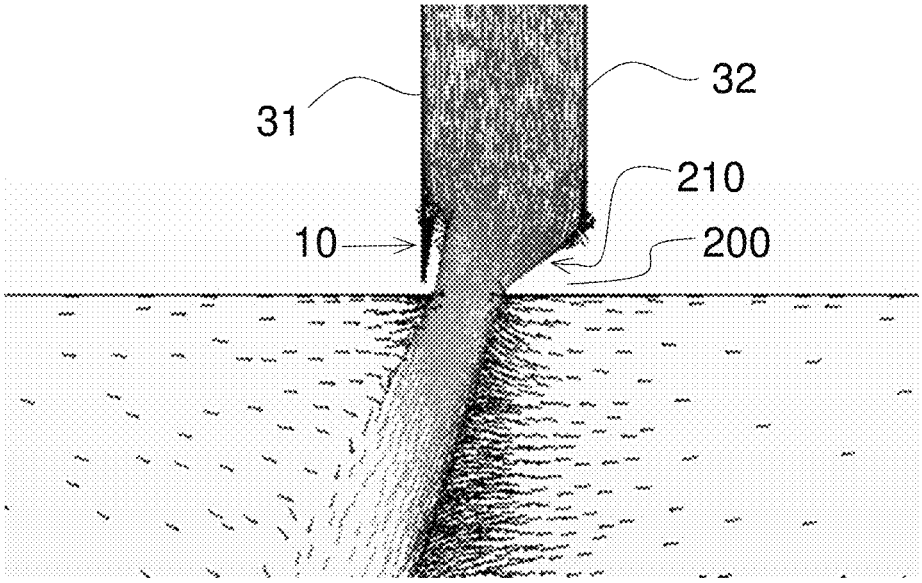
FIG. 3B is a diagram illustrating a result of the simulation performed as to the air flow direction of air blown out by the blow-out unit 1 according to the first embodiments in the state in which the turning angle of the plate member 10 is 80° relative to the horizontal.
Figure 4:
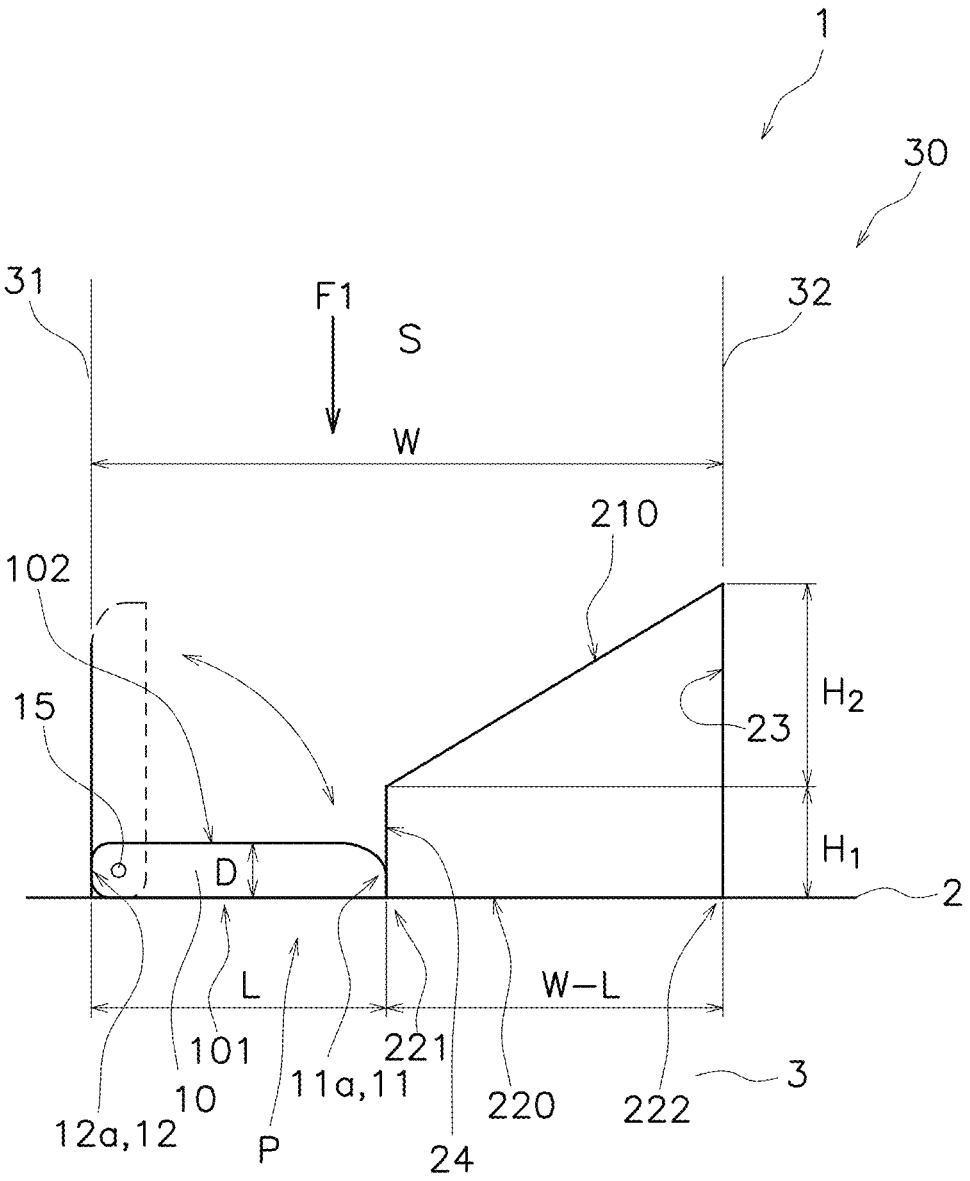
FIG. 4 is a vertical sectional view illustrating a state in which the plate member 10 of the blow-out unit 1 according to the first embodiments is on the blow-out port P and a state in which the plate member 10 turns 90° toward an air flow path S.
Figure 5:
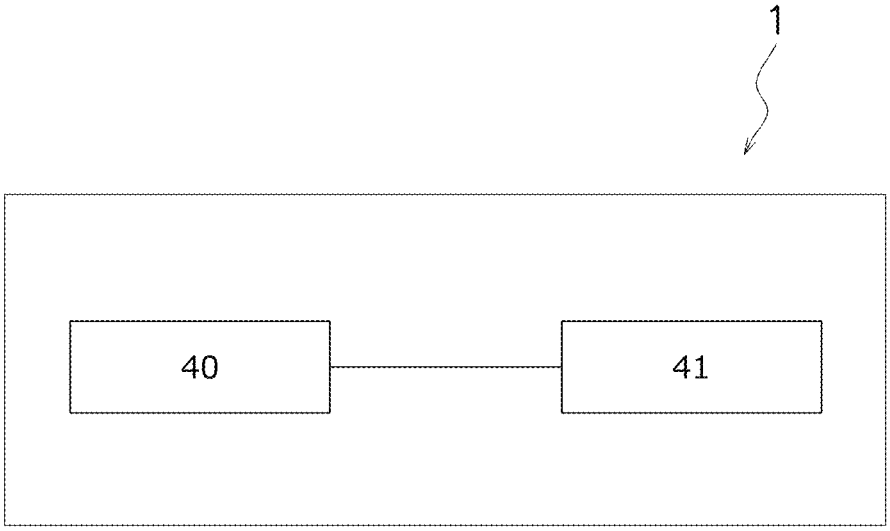
FIG. 5 is a control block diagram illustrating the blow-out unit 1 according to the first embodiments.

The blow-out unit 1 is described with reference to the drawings. FIG. 1 is a perspective view illustrating the blow-out unit 1 together with the ceiling, the blow-out unit 1 seen from below. FIGS. 2A and 2B are vertical sectional views each illustrating the blow-out unit 1 placed on the attic. Each FIG. 3A and FIG. 3B is a diagram illustrating a result of a simulation to be performed as to a flow of air in the blow-out unit 1 illustrated in each FIG. 2A and FIG. 2B respectively. FIG. 4 is a diagram illustrating a range of a turning angle of a plate member 10 in the blow-out unit 1. FIG. 5 is a control block diagram illustrating the blow-out unit 1.

The blow-out unit 1 includes the plate member 10, a guide portion 200, a chamber box 30, a panel 33, a control unit 40, and a motor 41. The chamber box 30 has a box shape and includes an intake port connected to a duct, and a blow-out port through which air is blown out. A configuration of the chamber box 30 will be described later. The blow-out unit 1 is placed on the attic such that the blow-out port of the chamber box 30 is aligned over an opening in the ceiling 2 of the room. The chamber box 30 defines a part of the air flow path S. The blow-out port of the chamber box 30 serves as the blow-out port P of the air flow path S. The plate member 10 and the guide portion 200 are placed in the blow-out port P. In the first embodiments, the blow-out port P has a rectangular shape as seen from below. The panel 33 is placed on the ceiling from below so as to cover an outer periphery of the blow-out port P in the ceiling. The blow-out unit 1 blows out air supplied thereto through the chamber box 30, toward the room 3 by a turn of the plate member 10.

The plate member 10 is a rectangular plate having a predetermined thickness. The plate member 10 is placed such that a surface thereof is flush with the ceiling. The plate member 10 includes a first surface 101 fronting onto the room and a second surface 102 fronting onto the air flow path S. The plate member 10 includes a first side 11*a* extending longitudinally and facing the guide portion 200, and a second side 12*a* extending in parallel with the first side 11*a* and abutting on a first wall surface 31 of the chamber box 30. The plate member 10 is substantially identical in longitudinal length with the blow-out port P.

The shape of the plate member 10 is appropriately changeable in accordance with the shape of the blow-out port P. The plate member 10 may have a square shape in addition to the rectangular shape. The plate member 10 may be chamfered. The plate member 10 has a thickness D that is not necessarily uniform. The plate member 10 may have a thickness that gradually decreases from a center of the plate member 10 toward ends on the four sides of the plate member 10.

In a state in which the plate member 10 is in a position that covers the blow-out port P as illustrated in FIG. 4, as seen in a section taken along a direction perpendicular to the blow-out port P and from the plate member 10 to the guide portion 200 (hereinafter, this section is referred to as a section X), the plate member 10 includes a first end 11 located near the guide portion 200, and a second end 12 located near the first wall surface 31 of the chamber box 30. The first end 11 is located on the first side 11*a* of the plate member 10. The second end 12 is located on the second side 12*a* of the plate member 10. The plate member 10 includes a rotating shaft 15 disposed near the second end 12. A distance between the rotating shaft 15 and the second end 12 is equal to or less than one-third of a distance (a length L) between the first end 11 and the second end 12 of the plate member 10. Further, the distance between the rotating shaft 15 and the second end 12 may be equal to or less than a half of the thickness D of the plate member 10. This configuration enables a reduction in volume of air flowing through a gap formed between the plate member 10 and the first wall surface 31 of the chamber box 30 when the plate member 10 turns. This configuration also inhibits the second end 12 from protruding from the blow-out port P toward the room when the plate member 10 turns. As illustrated in FIG. 4, the plate member 10 is turnable 90° on the rotating shaft 15 toward the air flow path S. The plate member 10 may be configured to turn on the rotating shaft 15 from 0° toward the air flow path S within an angular range from 45° or more to less than 90°. The plate member 10 may be configured to turn within any angular range as long as the plate member 10 is capable of adjusting an air flow direction.

The guide portion 200 is placed in the blow-out port P so as to face the plate member 10. The guide portion 200 is juxtaposed to the first end 11 of the plate member 10 as seen in the section X. The guide portion 200 includes, as seen in the section X, a first surface 210 fronting onto the air flow path S, a second surface 220 fronting onto the room, a third surface 23 abutting on a second wall surface 32 of the chamber box 30, and a fourth surface 24 abutting on the first end 11 of the plate member 10. Specifically, the first surface 210 extends from a first end to a second end of the guide portion 200. The first end of the guide portion 200 is juxtaposed to the first end 11 of the plate member 10. The second end of the guide portion 200 is located farther from the room than the first end of the guide portion 200 is, on the air flow path S. In addition, the second end of the guide portion 200 is located farther from the first end 11 of the plate member 10 than the first end of the guide portion 200 is. In other words, the first surface 210 is inclined downward from the second wall surface 32 toward the plate member 10, that is, from the air flow path S toward the room. In the example of FIG. 4 (a sectional view), the first surface 210 is inclined linearly (i.e., in a plane form). The first surface 210 may alternatively be inclined while being curved (i.e., in a curved form). The second surface 220 is flush with the ceiling 2. In the state in which the plate member 10 is in the position that covers the blow-out port P, the first surface 101, which fronts onto the room, of the plate member 10 is flush with the second surface 220. The second surface 220 has a rectangular shape as seen from below. The second surface 220 includes a first side 221 extending longitudinally and also extending in parallel with the first side 11*a* of the plate member 10, and a second side 222 extending in parallel with the first side 221 and abutting on the second wall surface 32 of the chamber box 30. The second surface 220 may be substantially identical in longitudinal length with the blow-out port P. The third surface 23 is in contact with the second wall surface 32 of the chamber box 30 so as to prevent air from flowing through a gap between the third surface 23 and the second wall surface 32. The fourth surface 24 is located between the first surface 210 and the second surface 220, and is parallel with the third surface 23.

The shape of the second surface 220 of the guide portion 200 is appropriately changeable in accordance with the shape of the blow-out port P. The second surface 220 may have a square shape in addition to the rectangular shape. The second surface 220 may be chamfered.

As illustrated in FIG. 4, the second surface 220 of the guide portion 200 and the first surface 101, which fronts onto the room, of the plate member 10 are flush with each other in the state in which the plate member 10 is in the position that covers the blow-out port P. Alternatively, one of the plate member 10 and the second surface 220 of the guide portion 200 may be located nearer to the air flow path S than the other is.

As illustrated in FIG. 4, the plate member 10 is turnable 90° until the second surface 102 becomes parallel with the first wall surface 31 from the state in which the plate member 10 is in the position that covers the blow-out port P. An air flow direction and an air volume change in accordance with the turning angle of the plate member 10. As illustrated in FIG. 4, in the state of the plate member 10 indicated with a solid line, that is, in the state in which the plate member 10 is in the position that covers the blow-out port P, the blow-out port P is closed with the plate member 10 and the guide portion 200.

The chamber box 30 has the box shape and includes the intake port connected to the duct, and the blow-out port through which air is blown out. The intake port may be connected via the duct to an air treatment unit of a ventilation apparatus, an air conditioning apparatus, or the like. The blow-out port is substantially identical in shape with the opening in the ceiling. The chamber box 30 includes four wall surfaces extending perpendicularly to the blow-out port P. The four wall surfaces have ends that define the blow-out port P. The four wall surfaces include the first wall surface 31 located near the plate member 10 and the second wall surface 32 located near the guide portion 200 as seen in the section X. The intake port of the chamber box 30 may be formed in an upper portion of the chamber box 30 or may be formed in one of the wall surfaces of the chamber box 30. In the blow-out port, the plate member 10 and the guide portion 200 are placed.

The blow-out unit 1 also includes the panel 33. The panel 33 is placed on the ceiling 2 from below so as to cover the outer periphery of the blow-out port P in the ceiling 2. The panel 33 is a frame having a predetermined thickness. The panel 33 protrudes inwardly from the ceiling 2 so as to partially cover the blow-out port P. The panel 33 covers a part of the second end 12 of the plate member 10 from below as seen in the section X. The panel 33 also covers a part of the second surface 220 of the guide portion 200 from below as seen in the section X. The panel 33 has a surface fronting onto the room, and this surface is located nearer to the room than the first surface 101 of the plate member 10 and the second surface 220 of the guide portion 200 are. Alternatively, the surface, which fronts onto the room, of the panel 33 may be flush with the first surface 101 of the plate member 10 and the second surface 220 of the guide portion 200. The panel 33 may cover only the ceiling 2. However, the panel 33, which protrudes inwardly from the ceiling 2 so as to partially cover the blow-out port P, inhibits air from flowing through a gap between the second end 12 of the plate member 10 and the first wall surface 31 of the chamber box 30.

The motor 41 allows the plate member 10 to turn on the rotating shaft 15. The motor 41 may be a stepping motor. The motor 41 may be placed in or outside the chamber box 30.

The control unit 40 is configured to control the motor 41. The control unit 40 is a computer. The control unit 40 includes a processor and a memory. The control unit 40 may be a microcomputer. The control unit 40 may be placed anywhere. The control unit 40 may be configured to control a plurality of blow-out units 1 at the same time.

The control unit 40 may perform control in accordance with an instruction from a remote controller operated by a user.

(2) Air Flow Direction Adjustment

In the blow-out unit 1, the plate member 10 and the first surface 210 of the guide portion 200 change a first air flow direction of air flowing toward the blow-out port P through the air flow path S, to a second air flow direction. In the state in which the plate member 10 is in the position that covers the blow-out port P, the blow-out port P is closed with the plate member 10 and the guide portion 200. When the plate member 10 turns, the first end 11 of the plate member 10 moves away from the blow-out port P toward the air flow path S, so that the blow-out port P is opened. Air is thus blown out toward the room 3 through the blow-out port P. Air flowing through the air flow path S passes through a clearance between the first surface 101 of the plate member 10 and the first surface 210 of the guide portion 200, and then is blown out toward the room 3 through the blow-out port P. On the air flow path S, the air flows in the first air flow direction F1 that is parallel with the first wall surface 31 or the second wall surface 32. When the air passes through the clearance between the first surface 101 of the plate member 10 and the first surface 210 of the guide portion 200, the first air flow direction F1 changes to the second air flow direction F21 or F22. The second air flow direction depends on the inclination angle of the first surface 210 of the guide portion 200 and the turning angle of the plate member 10. The inclination angle of the first surface 210 of the guide portion 200 is designed and fixed for each blow-out unit 1 in advance. The inclination angle of the first surface 210 of the guide portion 200 may fall within, for example, a range from 20° or more to 65° or less relative to the first air flow direction. The inclination angle of the first surface 210 may fall within a range from 25° or more to 70° or less, or from 40° or more to 55° or less relative to the horizontal. The turning angle of the plate member 10 changes in such a manner that the motor 41 causes the plate member 10 to turn.

The second air flow direction changes in accordance with the turning angle of the plate member 10. A simulation was performed on the blow-out unit 1 for examining how the air flow direction of air to be blown out toward the room 3 through the blow-out port P changes by changing the turning angle of the plate member 10. The simulation was performed under conditions that a system is entirely set in an isothermal field and a volume of air to be blown out is 10 $m^3$/min. The simulation was performed on the case of the turning angle of the plate member 10 in the blow-out unit 1 illustrated in FIG. 2A and FIG. 2B. FIGS. 3A and 3B respectively illustrate results of the simulation.

In FIGS. 2A, 3A, 2B, and 3B, the first surface 210 of the guide portion 200 is inclined 35° relative to the horizontal. As illustrated in FIGS. 2A and 3A, the second air flow direction F21 is tilted 40° relative to the horizontal when the plate member 10 turns 45° relative to the horizontal. Likewise, as illustrated in FIGS. 2B and 3B, the second air flow direction F22 is tilted 70° relative to the horizontal when the plate member 10 turns 80° relative to the horizontal. It is apparent from the results of the simulation that in the blow-out unit 1, an angular change from the first air flow direction F1 (the vertical direction) to the second air flow direction F21 or F22 decreases as the turning angle of the plate member 10 relative to the horizontal increases.

(3) Geometric Parameters of Blow-Out Unit 1

A description will be given of geometric parameters of the blow-out unit 1. FIG. 4 illustrates the geometric parameters of the blow-out unit 1 as seen in the vertical sectional view (the section X).

The length L between the first end 11 and the second end 12 of the plate member 10 may satisfy the following condition. The length L and a length W of the blow-out port P in the direction from the first end 11 to the second end 12 (i.e., a width of the air flow path; in FIG. 4, a distance between the first wall surface 31 and the second wall surface 32) may satisfy the following condition represented by Formula (1).

$$W/4<L<W/2 \quad (1)$$

In other words, the length L of the plate member 10 may be shorter than a length W-L of the guide portion 200 in the blow-out port P.

The thickness D of the plate member 10 may satisfy the following condition represented by Formula (2).

$$0<D<W/8 \quad (2)$$

In other words, the air flow direction is controlled smoothly by setting the thickness D of the plate member 10 within a certain range.

A length $H_1$ of the fourth surface 24 of the guide portion 200 may satisfy the following condition represented by Formula (3).

$$0\leq H_1<W/8 \quad (3)$$

In other words, the air flow direction is controlled smoothly by setting the length $H_1$ of the fourth surface 24 within a certain range.

A distance of the first surface 210 of the guide portion 200 along the first air flow direction F1 (i.e., an inclined surface height $H_2$) satisfies the following condition represented by Formula (4).

$$0\leq H_2<W \quad (4)$$

In other words, the air flow direction is controlled smoothly by setting the inclination angle of the first surface of the guide portion 200 within a certain range.

(4) Features (4-1)

The blow-out unit 1 according to one or more embodiments is placed at the blow-out port P of the air flow path S through which air is blown out toward the room 3, and is configured to blow out, toward the room 3, air supplied thereto through the air flow path S. The blow-out unit 1 includes the plate member 10 and the guide portion 200. The plate member 10 is configured to turn on the rotating shaft 15 so that the state in which the plate member 10 is in the position that covers the blow-out port P shifts to the state in which the plate member 10 is on the air flow path S. The guide portion 200 includes the first surface 210 fronting onto the air flow path S. The first surface 210 is inclined downward from the second wall surface 32 toward the first wall surface 31, that is, from the air flow path S toward the room. The blow-out unit 1 changes the first air flow direction F1 of air flowing toward the blow-out port P through the air flow path S, to the second air flow direction F21 or F22 in accordance with the turning angle of the plate member 10 and the inclination angle of the first surface 210 of the guide portion 200. The blow-out unit 1 is also configured to change the second air flow direction of air blown out through the blow-out port P, by changing the turning angle of the plate member 10.

The blow-out unit 1 according to one or more embodiments is thus capable of easily controlling the air flow direction with this simple configuration.

(4-2)

The plate member 10 has a substantially rectangular shape. As illustrated in FIG. 4, the plate member 10, which is in the position that covers the blow-out port P, includes the first end 11 (the first side 11*a*) located near the guide portion 200, the second end 12 located near the first wall surface 31, and the rotating shaft 15. The rotating shaft 15 is located nearer to the second end 12 than to the first end 11. The distance between the rotating shaft 15 and the second end 12 is equal to or less than one-third of the length L of the plate member (i.e., the distance between the first end 11 and the second end 12). In other words, the rotating shaft 15 is located between the first wall surface 31 and a straight line that passes a point corresponding to one-third of the length L of the plate member 10 from the second end 12 and extends perpendicularly to the blow-out port P.

Air is blown out through the blow-out port P in a single spot between the plate member 10 and the guide portion 200. In other words, there is no gap between the first wall surface 31 and the plate member 10, through which air is blown out. There is also no gap between the guide portion 200 and the second wall surface 32, through which air is blown out.

Air is thus blown out toward the room 3 through the clearance between the first surface 101 of the plate member 10 and the first surface 210 of the guide portion 200.

The blow-out unit 1 according to the first embodiments is thus capable of easily controlling the air flow direction with this simple configuration.

(4-3)

The first surface 210 of the guide portion 200 is inclined such that air flowing through the air flow path S in the first air flow direction F1 parallel with the first wall surface 31 or the second wall surface 32 collides with the first surface 210 of the guide portion 200. The inclination angle of the first surface 210 falls within the range from 20° or more to 65° or less relative to the first air flow direction F1.

The angular change from the first air flow direction F1 to the second direction decreases as the turning angle of the plate member 10, which turns from the blow-out port P (the horizontal) toward the air flow path S, increases.

(4-4)

In the first embodiments, the length L of the plate member 10 and the length W of the blow-out port P in the direction from the first end 11 to the second end 12 (i.e., the width of the air flow path) satisfy the relation of $W/4<L<W/2$. The length L of the plate member 10 is shorter than the length W-L of the guide portion 200.

(4-5)

The blow-out unit 1 also includes the chamber box 30 defining a part of the air flow path S. The chamber box 30 is placed on the attic or behind the sidewall. The chamber box 30 includes the first wall surface 31 located near the plate member 10 and the second wall surface 32 located near the guide portion 200. The chamber box 30 has the opening serving as the blow-out port P. In the opening, the plate member 10 and the guide portion 200 are placed.

(5) Modifications (5-1) Modification 1A

In the blow-out unit 1 according to the first embodiments, the rotating shaft 15 of the plate member 10 may be provided separately from the plate member 10. The rotating shaft 15 is not necessarily located between a plane which is an extension of the first surface 101 of the plate member 10 and a plane which is an extension of the second surface 102 of the plate member 10.

Figure 6:
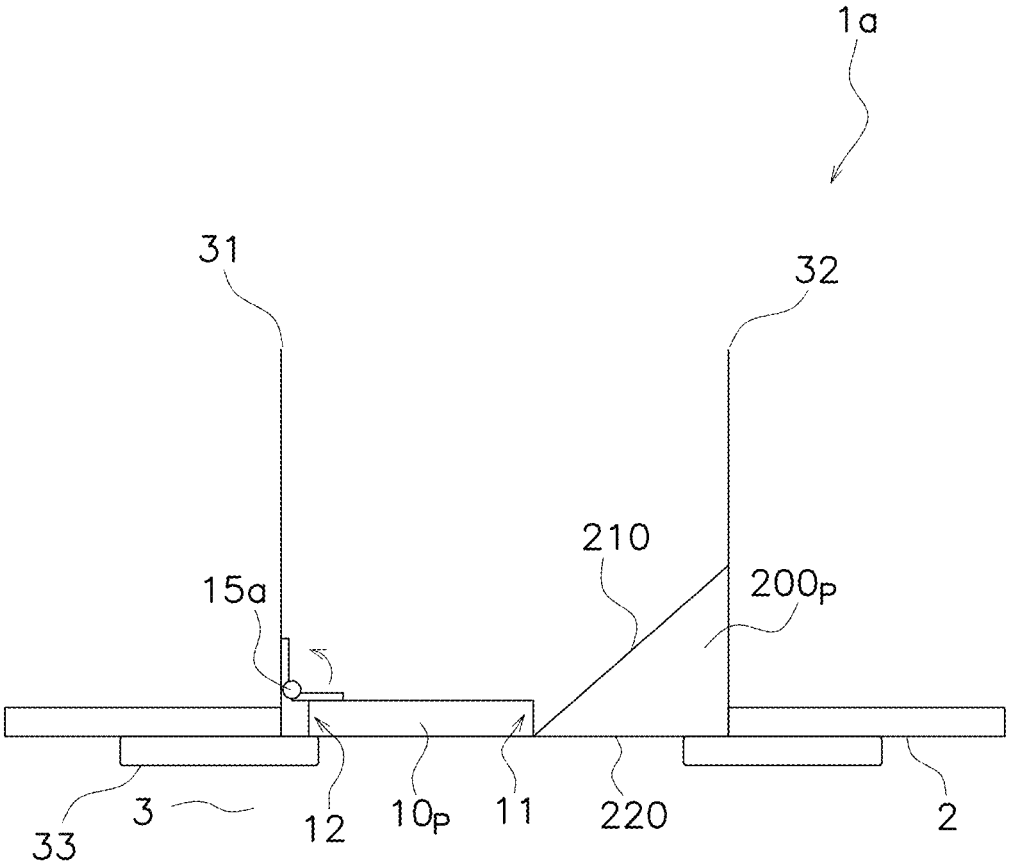
FIG. 6 is a vertical sectional view illustrating a plate member 10*p* of a blow-out unit 1 according to Modification 1A.

As illustrated in FIG. 6, a blow-out unit 1*a* according to Modification 1A is equal in configuration to the blow-out unit 1 according to the first embodiments except that a rotating shaft 15*a* is provided separately from a plate member 10*p*, and a first surface 210 and a second surface 220 of a guide portion 200*p* are in contact with each other.

In the example of FIG. 6 (a sectional view), in the blow-out unit 1*a* according to Modification 1A, the plate member 10*p* includes a first end 11 on a first side, and a second end 12 abutting on a first wall surface 31 of an air flow path S. A rotating fitting is fixed to the plate member 10*p* and the first wall surface 31. The rotating fitting includes the rotating shaft 15*a* on which the plate member 10*p* turns. The rotating shaft 15*a* of the rotating fitting is rotatable by a motor or manually.

(5-2) Modification 1B

A blow-out unit according to Modification 1B is equal in configuration to the blow-out unit 1 according to the first embodiments except that the blow-out unit according to Modification 1B does not include the motor and the control unit each described in the first embodiments. In the blow-out unit 1 according to Modification 1B, a turning angle of a plate member 10 is unchanged under normal circumstances. In changing the turning angle, the turning angle is changed manually.

The blow-out unit according to Modification 1B is used in a situation in which there is no necessity to constantly change an air flow direction.

(5-3) Modification 1C

In the blow-out unit 1 according to the first embodiments, air is blown out through the blow-out port P in a single spot between the plate member 10 and the guide portion 200. According to Modification 1C, air is blown out in two spots.

Figure 7A:
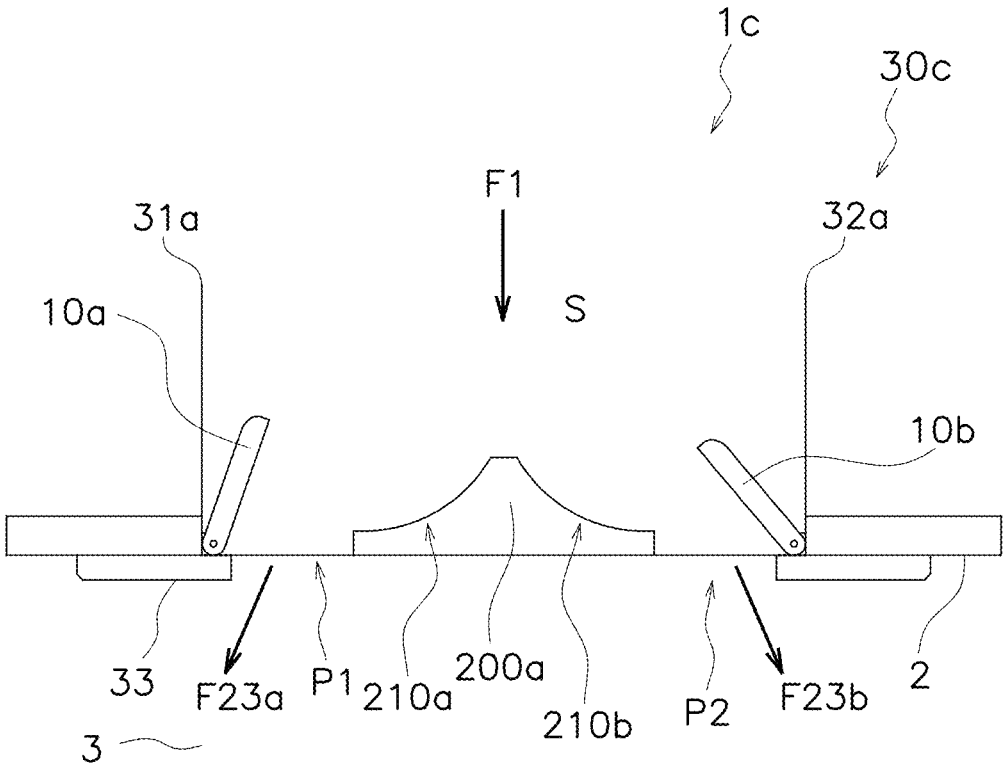
FIG. 7A is a vertical sectional view illustrating a blow-out unit 1*c* according to Modification 1C.
Figure 7B:
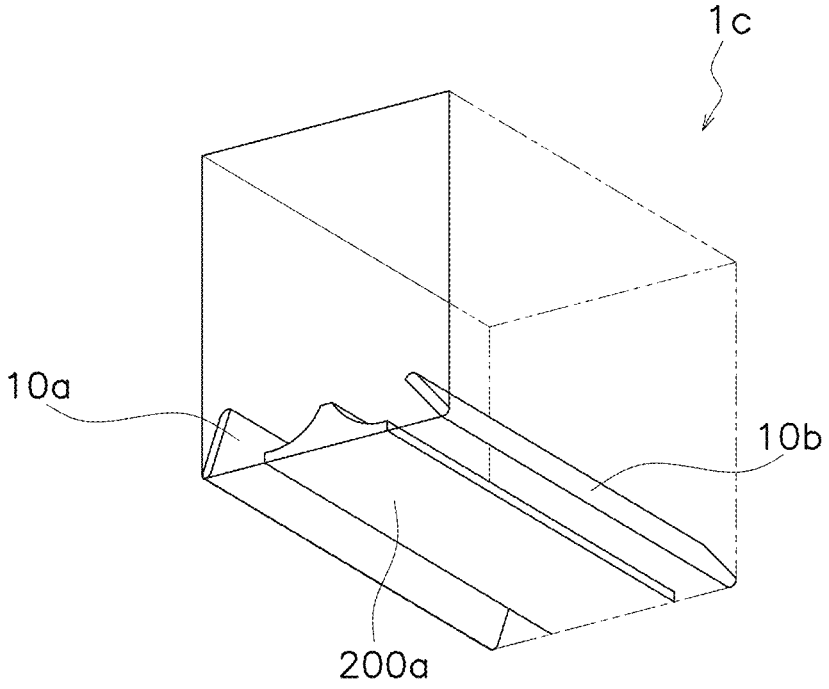
FIG. 7B is a perspective view illustrating the blow-out unit 1*c* according to Modification 1C, the blow-out unit 1*c* seen from below.
Figure 7C:
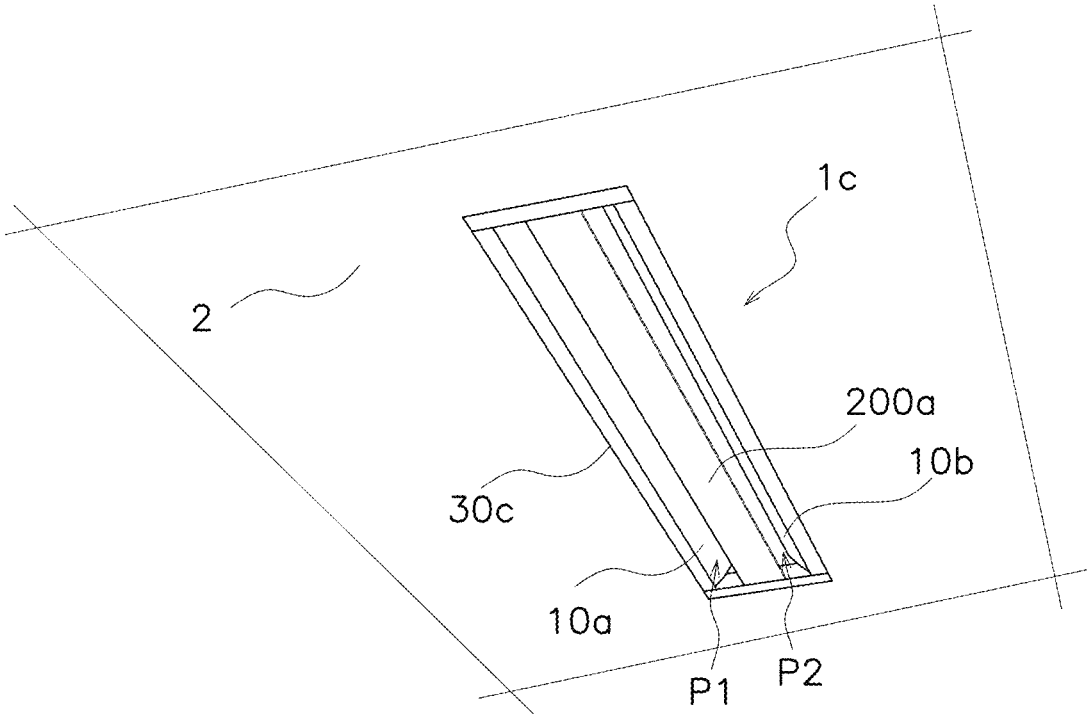
FIG. 7C is a perspective view illustrating the blow-out unit 1*c* according to Modification 1C together with a ceiling, the blow-out unit 1*c* seen from below.

As illustrated in FIGS. 7A to 7C, a blow-out unit 1*c* according to Modification 1C includes two plate members 10*a* and 10*b*, a guide portion 200*a*, and a chamber box 30*c* defining a blow-out port P. The plate members 10*a* and 10*b* and the guide portion 200*a* are placed in the blow-out port P. The plate member 10*a* and the plate member 10*b* are placed with the guide portion 200*a* interposed therebetween such that their longitudinal directions are parallel with each other. A first blow-out port P1 through which air is blown out is defined between the plate member 10*a* and the guide portion 200*a*. A second blow-out port P2 through which air is blown out is defined between the plate member 10*b* and the guide portion 200*a*. The guide portion 200*a* includes a first surface 210*a* located near the plate member 10*a*, and a first surface 210*b* located near the plate member 10*b*. The guide portion 200*a* is fixed at its longitudinal two ends to the chamber box 30*c*. As illustrated in FIGS. 7A and 7B, each of the first surface 210*a* and the first surface 210*b* is a curved surface that is recessed downward from an air flow path S toward a room 3. Each of the first surface 210*a* and the first surface 210*b* may alternatively be a flat surface. The first surface 210*a* is inclined downward from the air flow path S toward the room 3 in a direction from a center of the guide portion 200*a* toward the plate member 10*a*, as seen in a section taken along a direction perpendicular to the blow-out port P and from the plate member 10*a* to the plate member 10*b* (hereinafter, this section is referred to as a section Y). The first surface 210*b* is inclined downward from the air flow path S toward the room 3 in a direction from the center of the guide portion 200*a* toward the plate member 10*b*, as seen in the section Y. In other words, the center of the guide portion 200*a* as seen in the section Y, that is, a portion between the first surface 210*a* and the first surface 210*b* protrudes upward from the blow-out ports P1 and P2 toward the air flow path S. The plate member 10*a* and the plate member 10*b* turn in opposite directions from the blow-out port P toward the air flow path S. The blow-out unit 1*c* is equal in configuration to the blow-out unit 1 according to the first embodiments except the configuration described above.

Air supplied to the air flow path S flows through the air flow path S in a first air flow direction F1. The air is then divided into the air flowing toward the first blow-out port P1 and the air flowing toward the second blow-out port P2. Thus, the air is blown out toward the room 3 through the first blow-out port P1. In addition, the air is blown out toward the room 3 through the second blow-out port P2. In the first blow-out port P1, a second air flow direction F23*a* which is a blow-out direction changes by a turn of the plate member 10*a*. An angular change from the first air flow direction F1 to the second air flow direction F23*a* decreases as the turning angle of the plate member 10*a* relative to the horizontal increases. In other words, the angle of the second air flow direction F23*a* relative to the horizontal increases. Likewise, in the second blow-out port P2, a second air flow direction F23*b* which is a blow-out direction changes by a turn of the plate member 10*b*. An angular change from the first air flow direction F1 to the second air flow direction F23*b* decreases as the turning angle of the plate member 10*b* relative to the horizontal increases. In other words, the angle of the second air flow direction F23*b* relative to the horizontal increases.

In the blow-out unit 1*c* according to Modification 1C, the second air flow direction F23*a* and the second air flow direction F23*b* are controllable independently. In other words, the turning angle of the plate member 10*a* and the turning angle of the plate member 10*b* are controllable independently. In addition, both the blow-out port P1 and the blow-out port P2 may be opened at the same time. Alternatively, both the blow-out port P1 and the blow-out port P2 may be closed at the same time. Still alternatively, one of the blow-out port P1 and the blow-out port P2 may be opened while the other may be closed.

(5-4) Modification 1D

In the blow-out unit 1 according to the first embodiments, air is blown out through the blow-out port P in a single spot between the plate member 10 and the guide portion 200. According to Modification 1D, air is blown out in four spots.

Figure 8:
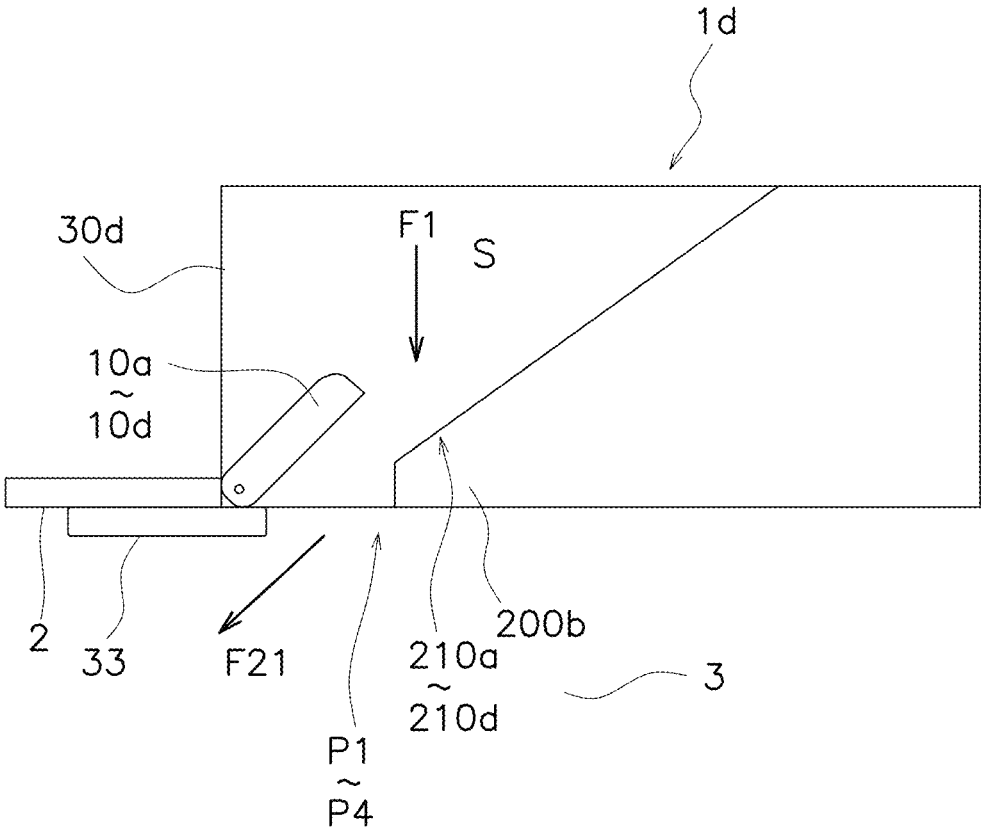
FIG. 8 is a vertical sectional view illustrating a blow-out unit 1*d* according to Modification 1D.
Figure 9:
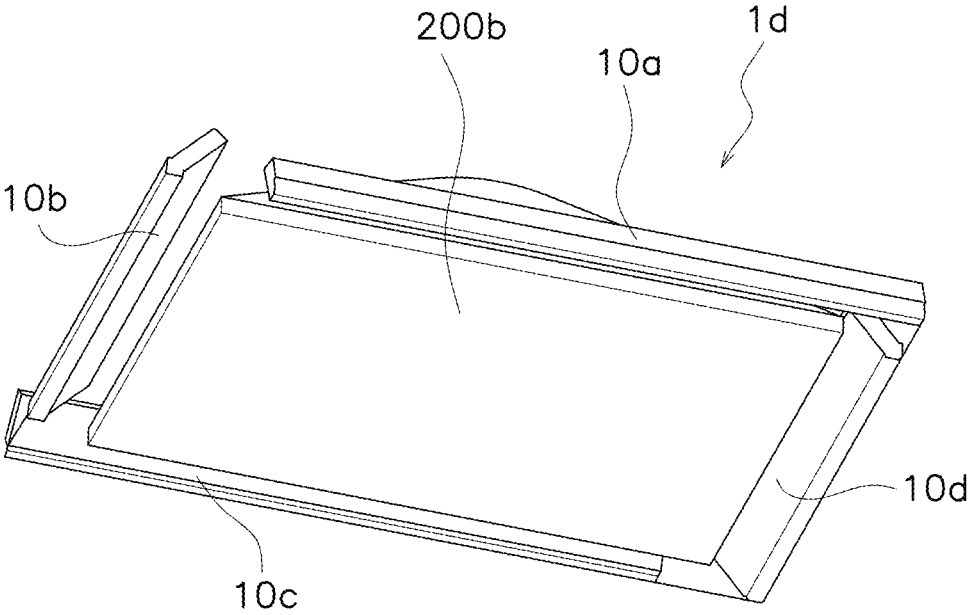
FIG. 9 is a perspective view illustrating the blow-out unit 1*d* according to Modification 1D, the blow-out unit 1*d* seen from below.
Figure 10:
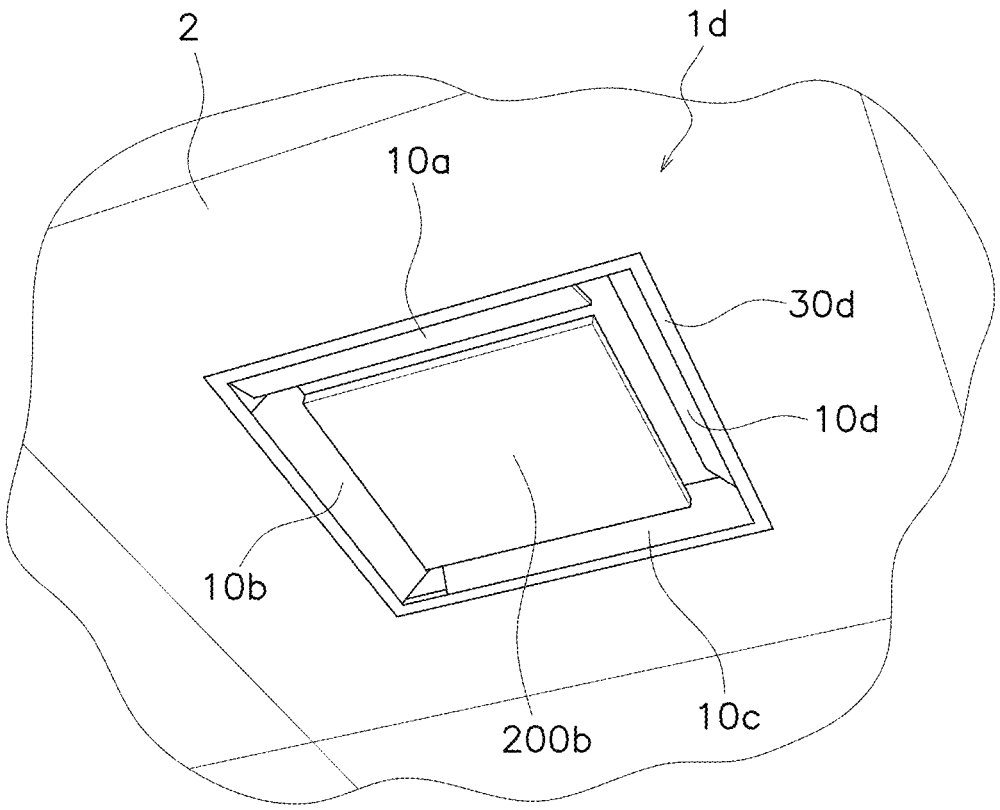
FIG. 10 is a perspective view illustrating the blow-out unit 1*d* according to Modification 1D placed in a ceiling 2, the blow-out unit 1*d* seen from below.

As illustrated in FIGS. 8 to 10, a blow-out unit 1*d* according to Modification 1D includes four plate members 10*a* to 10*d*, a guide portion 200*b*, and a chamber box 30*d* defining a blow-out port P. The plate members 10*a* to 10*d* and the guide portion 200*b* are placed in the blow-out port P. The plate member 10*a* and the plate member 10*c* are placed with the guide portion 200*b* interposed therebetween such that their longitudinal directions are parallel with each other. The plate member 10*b* and the plate member 10*d* are placed with the guide portion 200*b* interposed therebetween such that their longitudinal directions are parallel with each other. The longitudinal direction of each of the plate member 10*a* and the plate member 10*c* is perpendicular to the longitudinal direction of each of the plate member 10*b* and the plate member 10*d*. The plate members 10*a* to 10*d* are placed to surround four sides of a second surface of the guide portion 200*b* having a rectangular shape, with the blow-out unit 1*d* seen from below. Four blow-out ports P1 to P4, through which air is blown out, are respectively defined between the plate members 10*a* to 10*d* and the guide portion 200*b*. The guide portion 200*b* includes a first surface 210*a* located near the plate member 10*a*, a first surface 210*b* located near the plate member 10*b*, a first surface 210*c* located near the plate member 10*c*, and a first surface 210*d* located near the plate member 10*d*. Each of the first surfaces 210*a* to 210*d* is inclined downward from an air flow path S toward a room 3 in a direction from a center of the guide portion 200*b* toward the plate member 10*a*. The guide portion 200*b* may be fixed at its center to an inner upper surface of the chamber box 30*d* with a support. As illustrated in FIG. 8, each of the first surfaces 210*a* to 210*d* is a flat surface. Each of the first surfaces 210*a* to 210*d* may alternatively be a curved surface recessed downward from the air flow path S toward the room 3. The blow-out unit 1*d* is equal in configuration to the blow-out unit 1 according to the first embodiments except the configuration described above.

In the blow-out unit 1*d* according to Modification 1D, air supplied to the air flow path S flows through the air flow path S in a first air flow direction F1, branches to the blowout ports P1 to P4, and blow out into the room 3. In the blow-out ports P1 to P4, second air flow directions F24*a* each of which is a blow-out direction change by turns of the plate members 10*a* to 10*d*, respectively. Angular changes from the first air flow direction F1 to the second air flow directions F24*a* to F24*d* decrease as the turning angles of the plate members 10*a* to 10*d* relative to the horizontal increase. In other words, the angles of the second air flow directions F24*a* to F24*d* relative to the horizontal increase.

In the blow-out unit 1*d* according to Modification 1D, the second air flow directions, which are directions of air blown out toward the room through the blow-out ports P1 to P4, are controllable independently of one another. In other words, the turning angles of the plate members 10*a* to 10*d* are controllable independently of one another. In addition, all the blow-out ports P1 to P4 may be opened at the same time. Alternatively, all the blow-out ports P1 to P4 may be closed at the same time. Still alternatively, some of the blow-out ports P1 to P4 may be opened while the others may be closed.

(5-5) Modification 1E

A blow-out unit 1*e* according to Modification 1E is a constituent element of an air conditioning apparatus. The air conditioning apparatus is configured to carry out air conditioning operations including a heating operation, a cooling operation, a dehumidifying operation, a humidifying operation, and the like for a room. The air conditioning apparatus includes a fan, a heat exchanger, and the like in addition to the blow-out unit. Since an air flow path S is defined inside the air conditioning apparatus, the blow-out unit 1*e* does not include the chamber box 30 described in the first embodiments. The blow-out unit 1*e* is different in this respect from the blow-out unit 1 according to the first embodiments. A blow-out port P is a blow-out port formed in the air conditioning apparatus. The blow-out unit 1*e* does not necessarily include the panel 33 described in the first embodiments. The blow-out unit 1*e* is equal in configuration to the blow-out unit 1 according to the first embodiments except the configuration described above.

Second Embodiments (6) Configuration of Blow-Out Unit 100

A blow-out unit 100 is placed at a blow-out port P of an air flow path S through which air is blown out toward a room 3, and is configured to blow out, toward the room 3, air supplied thereto through the air flow path S. As used herein, air to be supplied to the blow-out unit 1 involves, for example, outside air, and heated, cooled, dehumidified, or humidified air in the room 3. The blow-out port P is bored in a ceiling or a wall of the room. The blow-out unit 100 is located nearer to the air flow path S than to the blow-out port P and is placed on an attic or behind a sidewall.

Figure 11:
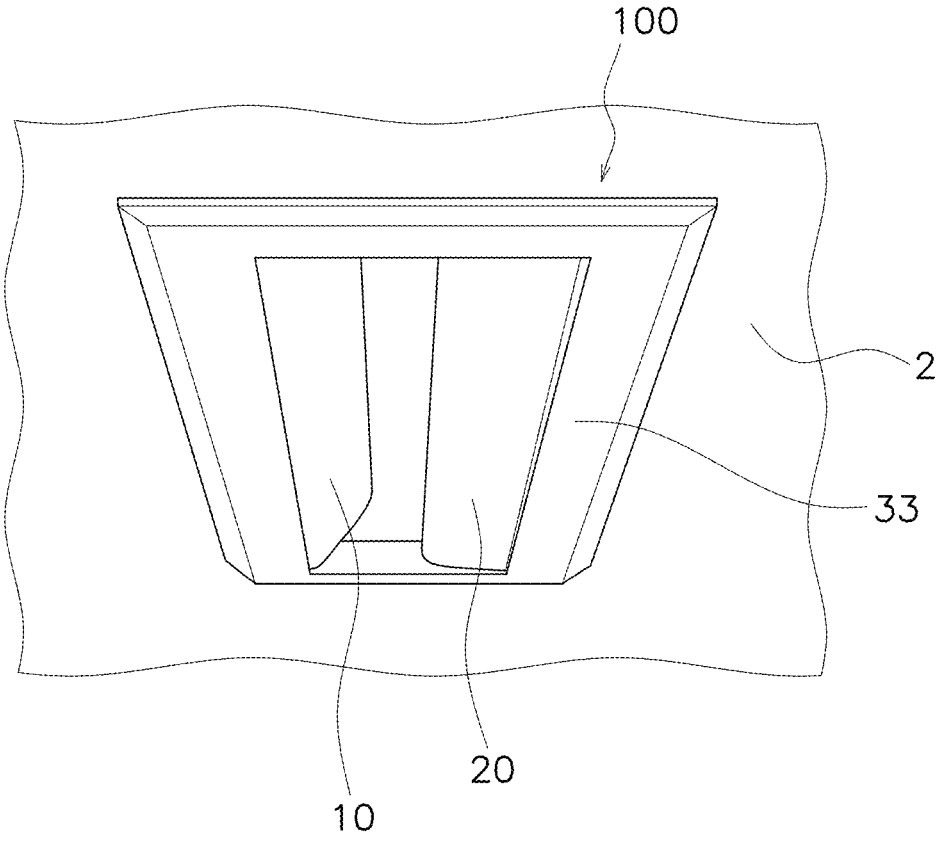
FIG. 11 is a perspective view illustrating a blow-out unit 100 according to second embodiments.
Figure 12:
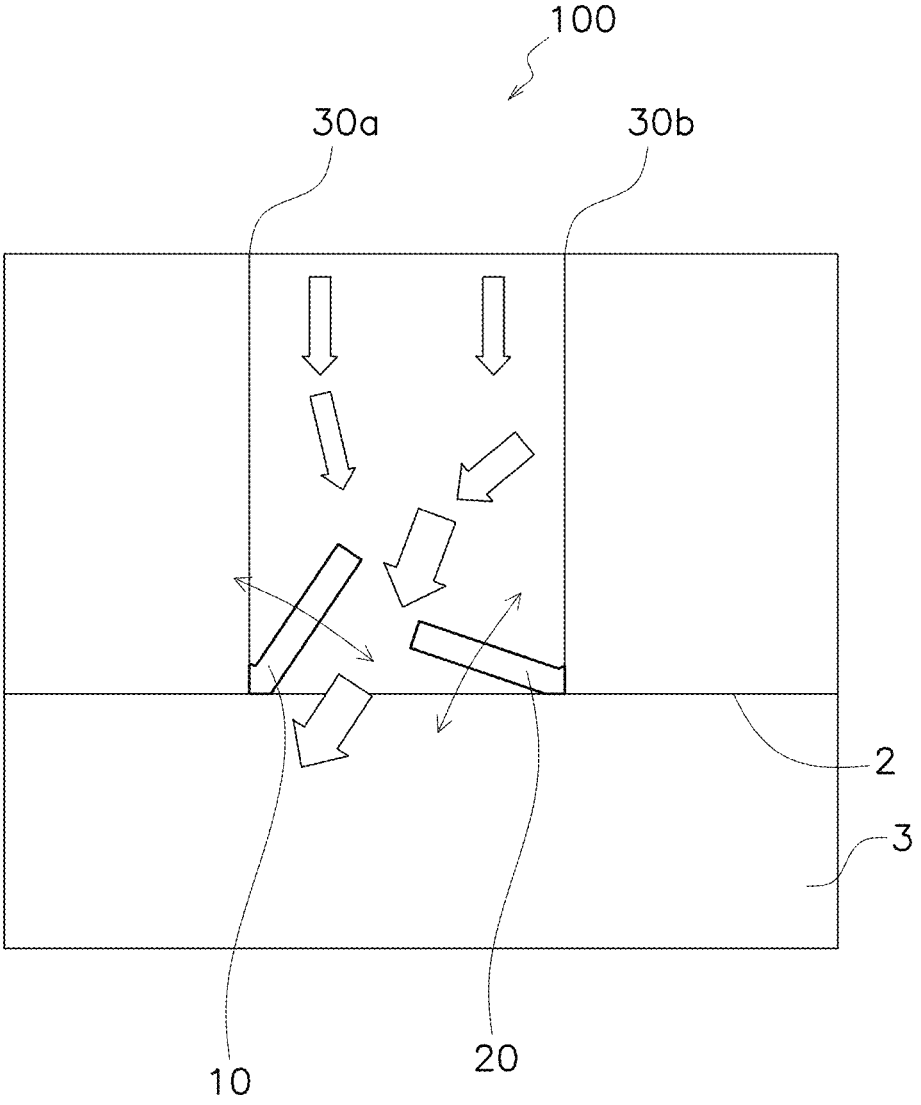
FIG. 12 is a vertical sectional view schematically illustrating a flow of air in the blow-out unit 100 according to the second embodiments.
Figure 13A:
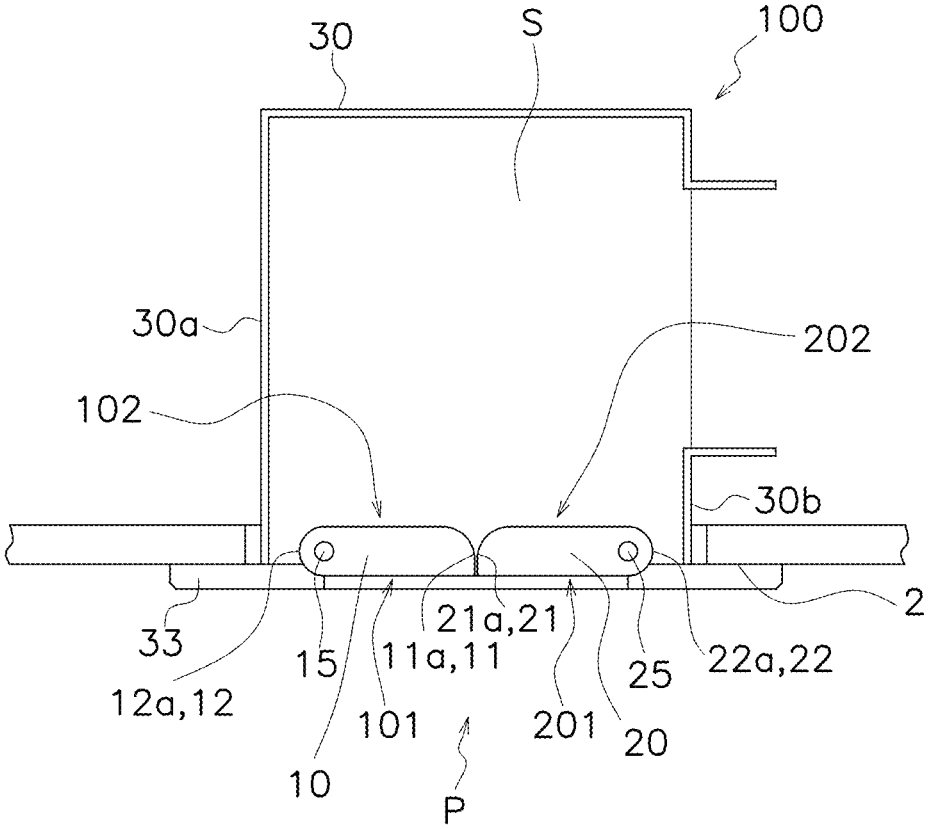
FIG. 13A is a vertical sectional view illustrating the blow-out unit 100 according to the second embodiments.
Figure 13B:
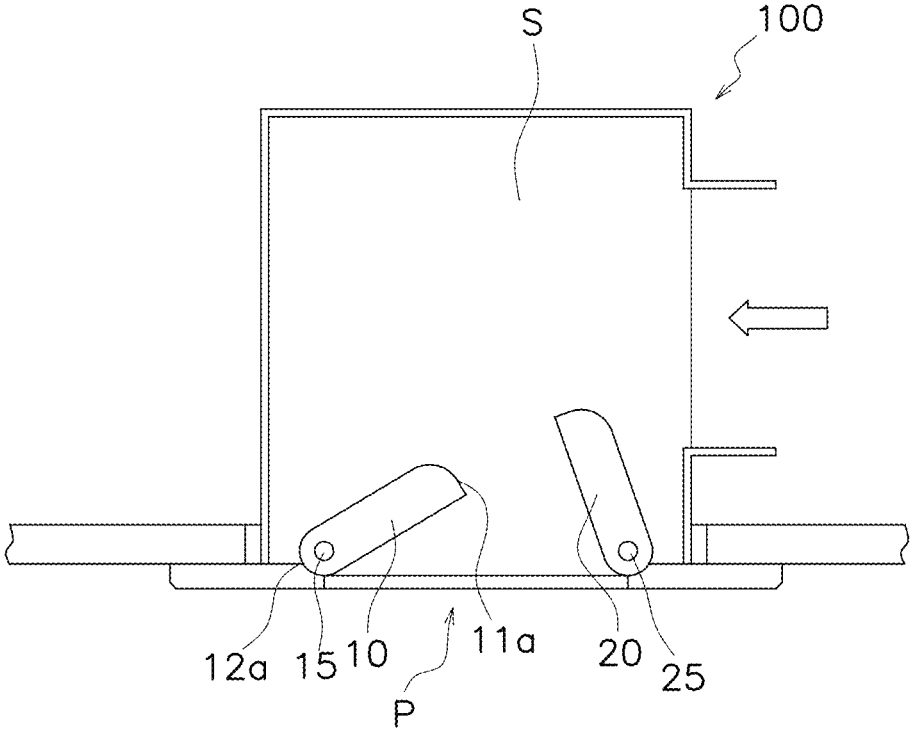
FIG. 13B is a vertical sectional view illustrating the blow-out unit 100 according to the second embodiments.
Figure 16:
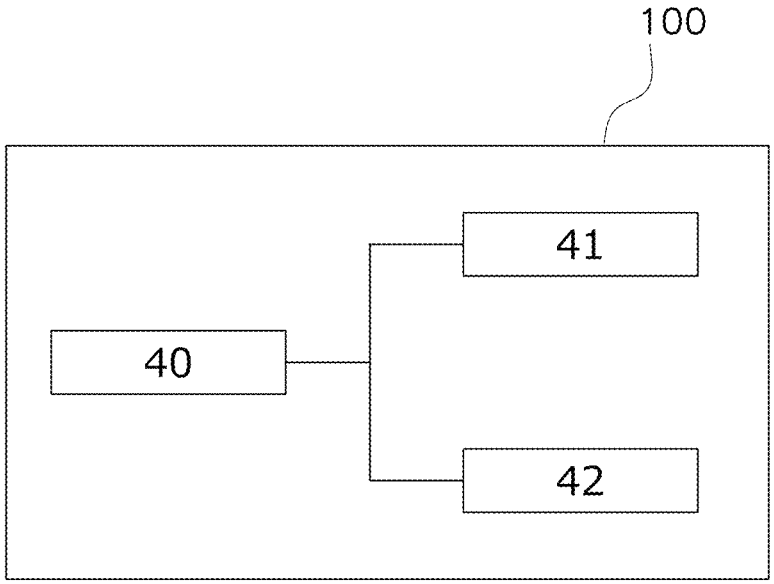
FIG. 16 is a control block diagram illustrating the blow-out unit 100 according to the second embodiments.

The blow-out unit 100 is described with reference to the drawings. FIG. 11 is a perspective view illustrating the blow-out unit 100 placed on the attic, the blow-out unit 100 seen from below. FIG. 12 is a vertical sectional view schematically illustrating a flow of air in the blow-out unit 100. FIG. 13A is a vertical sectional view illustrating the blow-out unit 100 in which a first plate member 10 and a second plate member 20 are in a first state. FIG. 13B is a vertical sectional view illustrating the blow-out unit 100 in which the first plate member 10 and the second plate member 20 are in a second state. FIG. 16 is a control block diagram illustrating the blow-out unit 100.

The blow-out unit 100 includes the first plate member 10, the second plate member 20, a chamber box 30, a panel 33, a control unit 40, a first motor 41, and a second motor 42. The chamber box 30 has a box shape and includes an intake port connected to a duct, and a blow-out port through which air is blown out. A configuration of the chamber box 30 will be described later. The blow-out unit 100 is placed on the attic such that the blow-out port of the chamber box 30 is aligned over an opening in the ceiling 2 of the room. The chamber box 30 defines a part of the air flow path S. The blow-out port of the chamber box 30 serves as the blow-out port P of the air flow path S. The first plate member 10 and the second plate member 20 are placed in the blow-out port P. In the second embodiments, the blow-out port P has a rectangular shape as seen from below. The panel 33 is placed on the ceiling from below so as to cover an outer periphery of the blow-out port P in the ceiling. The blow-out unit 100 blows out air supplied thereto through the chamber box 30, toward the room 3 by a turn of the first plate member 10 and a turn of the second plate member 20.

The first plate member 10 and the second plate member 20 correspond to a pair of plate members to be placed in the blow-out port P of the chamber box 30. One of the pair of plate members is referred to as a first plate member, and the other is referred to as a second plate member.

The first plate member 10 is a rectangular plate having a predetermined thickness. The first plate member 10 is placed such that a surface thereof is flush with the ceiling. The first plate member 10 includes a first surface 101 fronting onto the room and a second surface 102 fronting onto the air flow path S. The first plate member 10 includes a first side 11*a* extending longitudinally and facing the second plate member 20, and a second side 12*a* extending in parallel with the first side 11*a* and facing a first wall surface 30*a* of the chamber box 30. The first plate member 10 is substantially identical in longitudinal length with the blow-out port P. As illustrated in FIG. 13A, as seen in a section taken along a direction perpendicular to the blow-out port P and from the first plate member 10 to the second plate member 20 (hereinafter, this section is referred to as a section X), the first plate member 10 includes a first end 11 located near the second plate member 20 and a second end 12 located near the first wall surface 30*a* of the chamber box 30 (i.e., the air flow path S). The first end 11 is located on the first side 11*a* of the first plate member 10. The second end 12 is located on the second side 12*a* of the first plate member 10.

The shape of the first plate member 10 is appropriately changeable in accordance with the shape of the blow-out port P. The first plate member 10 may have a square shape in addition to the rectangular shape. The first plate member 10 may be chamfered. The first plate member 10 has a thickness that is not necessarily uniform. The first plate member 10 may have a thickness that gradually decreases from a center of the first plate member 10 toward ends on the four sides of the first plate member 10.

The first plate member 10 includes a first rotating shaft 15 disposed near the second end 12. A distance between the first rotating shaft 15 and the second end 12 is equal to or less than one-third of a distance between the first end 11 and the second end 12 of the first plate member 10. Further, the distance between the first rotating shaft 15 and the second end 12 may be equal to or less than a half of the thickness of the first plate member 10. This configuration enables a reduction in volume of air flowing through a gap formed between the first plate member 10 and the wall surface of the chamber box 30 when the first plate member 10 turns. This configuration also inhibits the second end 12 from protruding from the blow-out port P toward the room when the first plate member 10 turns. The first plate member 10 is turnable 90° on the first rotating shaft 15. The first plate member 10 may be configured to turn on the first rotating shaft 15 from 0° toward the air flow path S within an angular range from 45° or more to less than 90°. The first plate member 10 may be configured to turn within any angular range as long as the first plate member 10 is capable of adjusting an air flow direction.

As illustrated in FIG. 13A, in the first state, the first plate member 10 is in a position that covers the blow-out port P. As illustrated in FIG. 13B, in the second state, the first plate member 10 turns on the first rotating shaft 15 so that the first end 11 moves toward the air flow path S.

The second plate member 20 is a rectangular plate having a predetermined thickness. The second plate member 20 is placed such that a surface thereof is flush with the ceiling. The second plate member 20 includes a first surface 201 fronting onto the room and a second surface 202 fronting onto the air flow path S. The second plate member 20 includes a first side 21*a* extending longitudinally and facing the first plate member 10, and a second side 22*a* extending in parallel with the first side 21*a* and facing a second wall surface 30*b* of the chamber box 30. The second plate member 20 is substantially identical in longitudinal length with the blow-out port P. As illustrated in FIG. 13A, the second plate member 20 includes a first end 21 located near the first plate member 10 and a second end 22 located near the second wall surface 30*b* of the chamber box 30 (i.e., the air flow path S) as seen in the section X.

The shape of the second plate member 20 is appropriately changeable in accordance with the shape of the blow-out port P. The second plate member 20 may have a square shape in addition to the rectangular shape. The second plate member 20 may be chamfered. The second plate member 20 has a thickness that is not necessarily uniform. The second plate member 20 may have a thickness that gradually decreases from a center of the second plate member 20 toward ends on the four sides of the second plate member 20.

The second plate member 20 includes a second rotating shaft 25 disposed near the second end 22. A distance between the second rotating shaft 25 and the second end 22 is equal to or less than one-third of a distance between the first end 21 and the second end 22 of the second plate member 20. Further, the distance between the second rotating shaft 25 and the second end 22 may be equal to or less than a half of the thickness of the second plate member 20. This configuration enables a reduction in volume of air flowing through a gap formed between the second plate member 20 and the second wall surface 30*b* of the chamber box 30 when the second plate member 20 turns. This configuration also inhibits the second end 22 from protruding from the blow-out port P toward the room when the second plate member 20 turns. The second plate member 20 is turnable 90° on the second rotating shaft 25. The second plate member 20 may be configured to turn on the second rotating shaft 25 from 0° toward the air flow path S within an angular range from 45° or more to less than 90°. The second plate member 20 may be configured to turn within any angular range as long as the second plate member 20 is capable of adjusting an air flow direction.

As illustrated in FIG. 13A, in the first state, the second plate member 20 is in a position that covers the blow-out port P. As illustrated in FIG. 13B, in the second state, the second plate member 20 turns on the second rotating shaft 25 so that the first end 21 moves toward the air flow path S.

As illustrated in FIGS. 13A and 13B, the first plate member 10 turns counterclockwise, so that the first state shifts to the second state. On the other hand, the second plate member 20 turns clockwise, so that the first state shifts to the second state.

As illustrated in FIG. 13A, when both the first plate member 10 and the second plate member 20 are in the first state, the blow-out port P is closed. At this time, the first end 11 of the first plate member 10 and the first end 21 of the second plate member 20 face each other. In addition, the first surface 101 of the first plate member 10 and the first surface 201 of the second plate member 20 are flush with each other. However, the first surface 101 of the first plate member 10 and the first surface 201 of the second plate member 20 are not necessarily flush with each other. For example, one of the first surface 101 of the first plate member 10 and the first surface 201 of the second plate member 20 may be located nearer to the air flow path S than the other is.

When one of or both the first plate member 10 and the second plate member 20 is or are in the second state, the blow-out port P is open. In FIGS. 12 and 13B, both the first plate member 10 and the second plate member 20 are in the second state. As illustrated in FIG. 12, an air flow direction is changeable by making the turning angle of the first plate member 10 different from the turning angle of the second plate member 20. In addition, a blow distance D1 of air is changeable in accordance with the turning angle of the first plate member 10 and the turning angle of the second plate member 20.

The chamber box 30 defines a part of the air flow path S. The chamber box 30 is placed on the attic or behind the sidewall. The chamber box 30 has the box shape and includes the intake port connected to the duct, and the blow-out port through which air is blown out. The intake port may be connected via the duct to an air treatment unit of a ventilation apparatus, an air conditioning apparatus, or the like. The blow-out port is substantially identical in shape with the opening in the ceiling. The chamber box 30 includes four wall surfaces extending perpendicularly to the blow-out port P. The four wall surfaces have ends that define the blow-out port P. The four wall surfaces include the first wall surface 30*a* located near the first plate member 10 and the second wall surface 30*b* located near the second plate member 20 as seen in the section X. The intake port of the chamber box 30 may be formed in an upper portion of the chamber box 30 or may be formed in a sidewall surface of the chamber box 30. As illustrated in FIGS. 13A and 13B, the intake port is formed in the second wall surface 30*b*. In the second embodiments, the chamber box 30 defines the air flow path S; however, the chamber box 30 is not an essential constituent element.

The panel 33 is placed on the ceiling 2 from below so as to cover the outer periphery of the blow-out port P in the ceiling 2. The panel 33 is a frame having a predetermined thickness. The panel 33 protrudes inwardly from the ceiling so as to partially cover the blow-out port P. The panel 33 covers a part of the second end 12 of the first plate member 10 from below as seen in the section X. The panel 33 also covers a part of the second end 22 of the second plate member 20 from below as seen in the section X. The panel 33 has a surface fronting onto the room, and this surface is located nearer to the room than the first surface 101 of the first plate member 10 and the first surface 201 of the second plate member 20 are. Alternatively, the surface, which fronts onto the room, of the panel 33 may be flush with the first surface 101 of the first plate member 10 and the first surface 201 of the second plate member 20. The panel 33 may cover only the ceiling. However, the panel 33, which protrudes inwardly from the ceiling so as to partially cover the blow-out port P, inhibits air from flowing through a gap between the second end 12 of the first plate member 10 and the first wall surface 30*a* of the chamber box 30 and a gap between the second end 22 of the second plate member 20 and the second wall surface 30*b* of the chamber box 30. The panel 33 covers the blow-out port of the chamber box 30, the gap between the first plate member 10 and the wall surface of the chamber box 30, and the gap between the second plate member 20 and the wall surface of the chamber box 30 so as to be invisible from below. The panel 33 therefore improves the appearance of the blow-out unit 100; however, the panel 33 is not an essential constituent element.

The first motor 41 allows the first plate member 10 to turn. The second motor 42 allows the second plate member 20 to turn. In other words, the first plate member 10 and the second plate member 20 are turnable independently. Each of the first motor 41 and the second motor 42 may be a stepping motor. Each of the first motor 41 and the second motor 42 may be placed in or outside the chamber box 30.

FIG. 16 is the control block diagram illustrating the blow-out unit 100. The control unit 40 is configured to control the first motor 41 and the second motor 42. The control unit 40 is a computer. The control unit 40 includes a processor and a memory. The control unit 40 may be a microcomputer. The control unit 40 may be placed anywhere. The control unit 40 may be configured to control a plurality of blow-out units 100 at the same time. The control unit 40 may be used together with a control unit configured to control constituent elements of another air conditioning apparatus. For example, the control unit 40 may be used together with a control unit for a heat exchanger configured to heat or cool air to be supplied to the room 3. The control unit 40 may perform control in cooperation with the control unit for such a constituent element.

The control unit 40 may perform control in accordance with an instruction from a remote controller operated by a user.

(7) Control of Blow Distance D1 of Air to be Blown Out by Blow-Out Unit 100

Figure 14A:
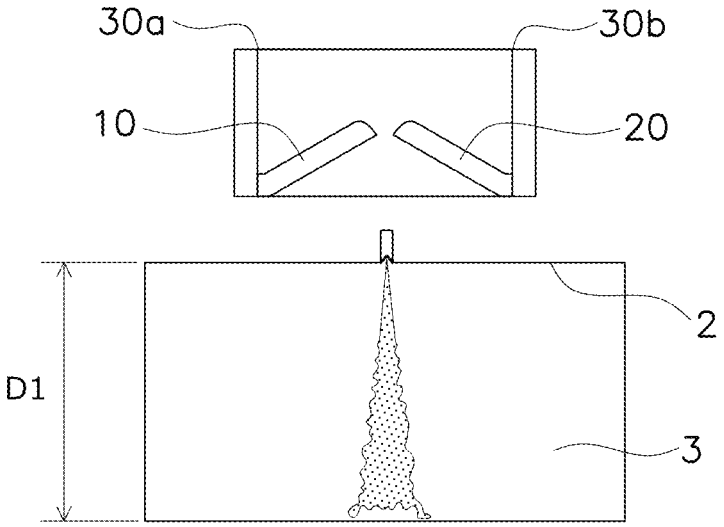
FIG. 14A is a diagram illustrating a turning angle of the first plate member 10, a turning angle of the second plate member 20, and a blow distance D1 of air in the blow-out unit 100 according to the second embodiments.
Figure 14B:
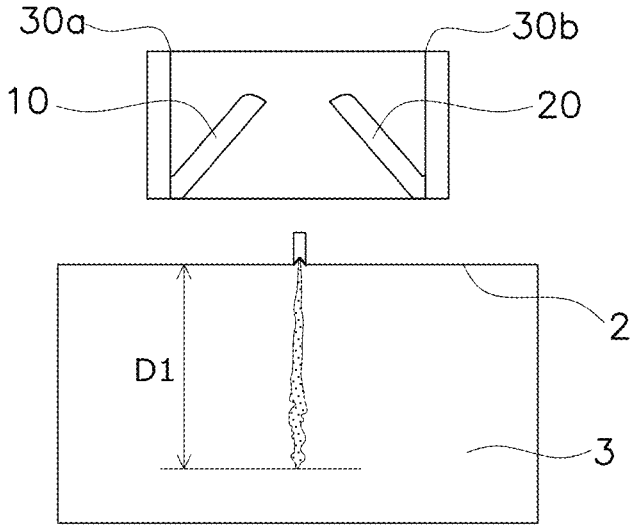
FIG. 14B is a diagram illustrating the turning angle of the first plate member 10, the turning angle of the second plate member 20, and the blow distance D1 of air in the blow-out unit 100 according to the second embodiments.
Figure 14C:
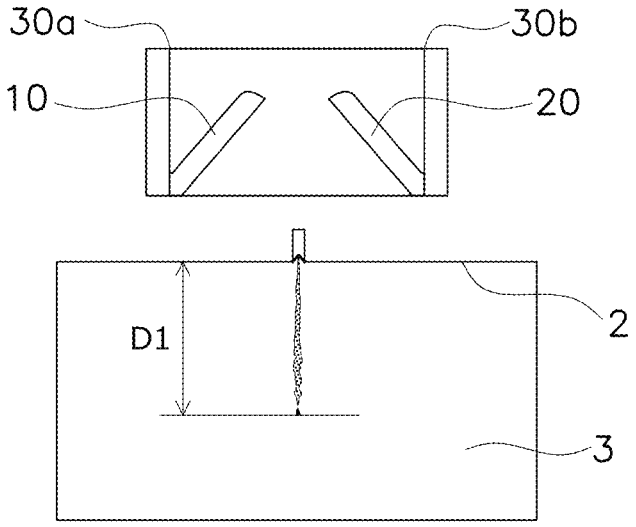
FIG. 14C is a diagram illustrating the turning angle of the first plate member 10, the turning angle of the second plate member 20, and the blow distance D1 of air in the blow-out unit 100 according to the second embodiments.

A simulation was performed on the blow-out unit 100 for examining how the blow distance D1 of air blown out toward the room 3 through the blow-out port P changes by changing the turning angle of the first plate member 10 and the turning angle of the second plate member 20. The simulation was performed under conditions that a system is entirely set in an isothermal field and a volume of air to be blown out is 10 $m^3$/min. FIGS. 14A to 14C illustrate results of the simulation. In FIGS. 14A to 14C, the upper sides each illustrate the turning angle of the first plate member 10 and the turning angle of the second plate member 20, and the lower sides each illustrate an area where an air velocity is equal to or more than 1 m/s. It is understood from FIGS. 14A to 14C that in this simulation, the turning angle of the first plate member 10 is set to be equal to the turning angle of the second plate member 20. In other words, the first plate member 10 and the second plate member 20 turn symmetrically with respect to a center line.

In FIG. 14A, the turning angle of each of the first plate member 10 and the second plate member 20 is set at 30° relative to the horizontal. In this case, air blown out through the blow-out port P in the ceiling 2 reaches a floor of the room 3. The blow distance D1 is 2.6 m. In FIG. 14B, the turning angle of each of the first plate member 10 and the second plate member 20 is set at 50° relative to the horizontal. The blow distance D1 of air blown out in this case is 2.1 m. In FIG. 14C, the turning angle of each of the first plate member 10 and the second plate member 20 is set at 65° relative to the horizontal. The blow distance D1 of air blown out in this case is 1.6 m. It is understood from FIGS. 14A to 14C that the blow distance D1 decreases as the turning angle of each of the first plate member 10 and the second plate member 20 increases.

(8) Control of Air Flow Direction of Air to be Blown Out by Blow-Out Unit 100

A simulation was performed on the blow-out unit 100 for examining how the air flow direction of air blown out toward the room 3 through the blow-out port P changes by changing the turning angle of the first plate member 10 and the turning angle of the second plate member 20. The simulation was performed under conditions that a system is entirely set in an isothermal field and a volume of air to be blown out is 10 $m^3$/min. FIGS. 15A to 15E illustrate results of the simulation. In FIGS. 15A to 15E, the upper sides each illustrate the turning angle of the first plate member 10 and the turning angle of the second plate member 20, and the lower sides each illustrate an area where an air velocity is equal to or more than 1 m/s. In this simulation, FIG. 15A to 15D each illustrate a case where the turning angle of the first plate member 10 is set to be smaller than the turning angle of the second plate member 20. The air flow direction of air blown out through the blow-out port P is tilted toward the second plate member 20. FIG. 15E illustrates a case where the turning angle of the first plate member 10 is set to be equal to the turning angle of the second plate member 20. The air flow direction of air blown out through the blow-out port P is the vertical direction.

Figure 15A:
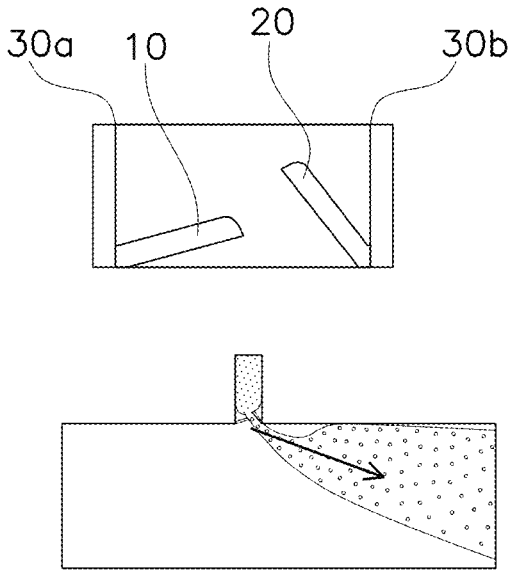
FIG. 15A is a diagram illustrating the turning angle of the first plate member 10, the turning angle of the second plate member 20, and an air flow direction in the blow-out unit 100 according to the second embodiments.
Figure 15B:
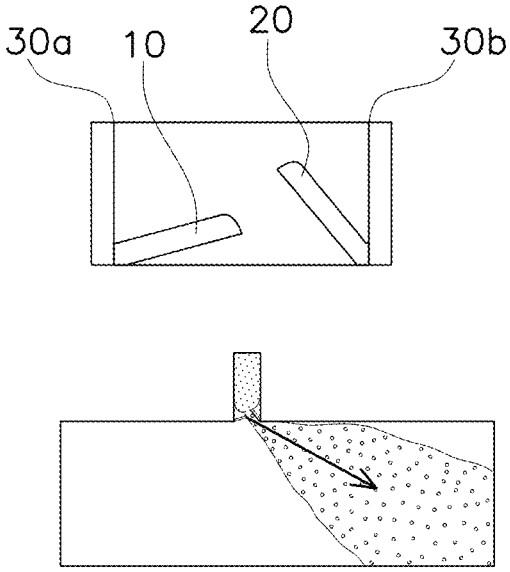
FIG. 15B is a diagram illustrating the turning angle of the first plate member 10, the turning angle of the second plate member 20, and the air flow direction in the blow-out unit 100 according to the second embodiments.
Figure 15C:
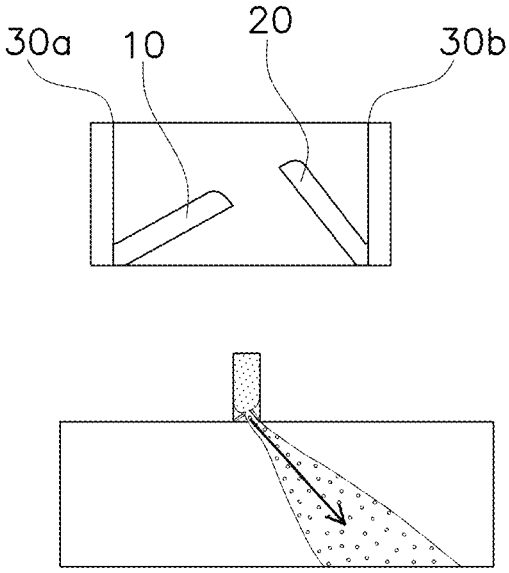
FIG. 15C is a diagram illustrating the turning angle of the first plate member 10, the turning angle of the second plate member 20, and the air flow direction in the blow-out unit 100 according to the second embodiments.
Figure 15D:
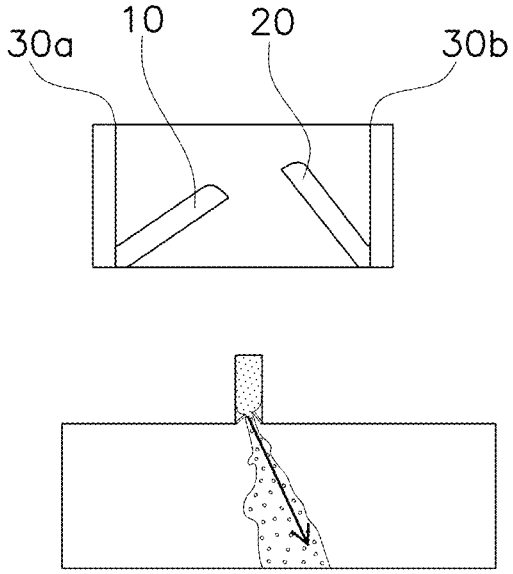
FIG. 15D is a diagram illustrating the turning angle of the first plate member 10, the turning angle of the second plate member 20, and the air flow direction in the blow-out unit 100 according to the second embodiments.
Figure 15E:
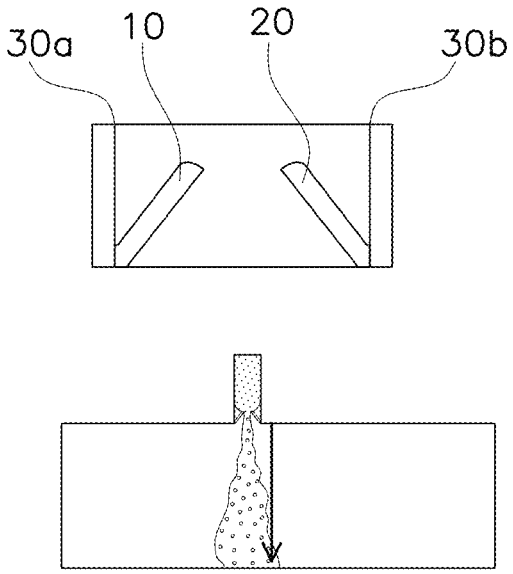
FIG. 15E is a diagram illustrating the turning angle of the first plate member 10, the turning angle of the second plate member 20, and the air flow direction in the blow-out unit 100 according to the second embodiments.

In FIG. 15A, the turning angle of the first plate member 10 is set at 15° relative to the horizontal, and the turning angle of the second plate member 20 is set at 52° relative to the horizontal. The air flow direction (i.e., an air current angle) is tilted 20° relative to the horizontal toward the second plate member 20. In FIG. 15B, the turning angle of the first plate member 10 is set at 16° relative to the horizontal, and the turning angle of the second plate member 20 is set at 50° relative to the horizontal. The air flow direction (i.e., the air current angle) is tilted 30° relative to the horizontal toward the second plate member 20. In FIG. 15C, the turning angle of the first plate member 10 is set at 30° relative to the horizontal, and the turning angle of the second plate member 20 is set at 52° relative to the horizontal. The air flow direction (i.e., the air current angle) is tilted 45° relative to the horizontal toward the second plate member 20. In FIG. 15D, the turning angle of the first plate member 10 is set at 35° relative to the horizontal, and the turning angle of the second plate member 20 is set at 52° relative to the horizontal. The air flow direction (i.e., the air current angle) is tilted 65° relative to the horizontal toward the second plate member 20. In FIG. 15E, each of the turning angle of the first plate member 10 and the turning angle of the second plate member 20 is set at 52° relative to the horizontal. The air flow direction (i.e., the air current angle) is the vertical direction.

As described in (2) or (3) above, the air flow direction of air blown out toward the room 3 depends on the turning angle of the first plate member 10 and the turning angle of the second plate member 20. The memory of the control unit 40 stores, in advance, the turning angle of the first plate member 10, the turning angle of the second plate member 20, and the air flow direction of air blown out toward the room 3, each obtained by a preliminary test. In conditioning air in the room, the control unit 40 controls the turning angle of the first plate member 10 and the turning angle of the second plate member 20, using the data stored in the memory in order to achieve a predetermined air flow direction of air blown out blown out toward the room 3.

(9) Features (9-1)

The blow-out unit 100 according to the second embodiments is placed at the blow-out port P of the air flow path S through which air is blown out toward the room 3, and is configured to blow out, toward the room 3, air supplied thereto through the air flow path S. The blow-out unit 100 includes the first plate member 10 and the second plate member 20. The first plate member 10 is configured to turn on the first rotating shaft 15 so that the first state in which the first plate member 10 is in the position that covers the blow-out port P shifts to the second state in which the first plate member 10 is on the air flow path S. Likewise, the second plate member 20 is configured to turn on the second rotating shaft 25 so that the first state in which the second plate member 20 is in the position that covers the blow-out port P shifts to the second state in which the second plate member 20 is on the air flow path S. In the first state, the first side 11*a* located away from the first rotating shaft 15 in the first plate member 10 faces the first side 21*a* located away from the second rotating shaft 25 in the second plate member 20.

With this configuration, the blow-out unit 100 according to the second embodiments is capable of changing the air flow direction and blow distance D1 of air blown out through the blow-out port P, by changing the turning angle of the first plate member 10 and the turning angle of the second plate member 20.

(9-2)

The first plate member 10 has a substantially rectangular shape. As illustrated in FIG. 13A, the first plate member 10 includes, in the first state, the first side 11*a* located near the second plate member 20, the second side 12*a* located near the first wall surface 30*a* of the air flow path S (or the chamber box 30), and the first rotating shaft 15. The first rotating shaft 15 is located nearer to the second side 12*a* than to the first side 11*a*. The distance between the first rotating shaft 15 and the second side 12*a* is equal to or less than one-third of the distance between the first side 11*a* and the second side 12*a* of the first plate member 10. In other words, the first rotating shaft 15 is located between the first wall surface 30*a* and a straight line that passes a point corresponding to one-third of the length of the first plate member 10 from the second side 12*a* and extends perpendicularly to the blow-out port P.

Likewise, the second plate member 20 has a substantially rectangular shape. As illustrated in FIG. 13A, the second plate member 20 includes, in the first state, the first side 21*a* located near the first plate member 10, the second side 22*a* located near the second wall surface 30*b* of the air flow path S (or the chamber box 30), and the second rotating shaft 25. The second rotating shaft 25 is located nearer to the second side 22*a* than to the first side 21*a*. The distance between the second rotating shaft 25 and the second side 22*a* is equal to or less than one-third of the distance between the first side 21*a* and the second side 22*a* of the second plate member 20. In other words, the second rotating shaft 25 is located between the second wall surface 30*b* and a straight line that passes a point corresponding to one-third of the length of the second plate member 20 from the second side 22*a* and extends perpendicularly to the blow-out port P.

Air is blown out through the blow-out port P in a single air blow-out portion between the first plate member 10 and the second plate member 20. In other words, there is no gap between the first plate member 10 and the first wall surface 30*a*, through which air is blown out. There is also no gap between the second plate member 20 and the second wall surface 30*b*, through which air is blown out.

With this configuration, the blow-out port P according to the second embodiments is capable of easily controlling the air flow direction and blow distance D1 of air.

(9-3)

In the blow-out unit 100 according to the second embodiments, the first surface 101 of the first plate member 10 and the first surface 201 of the second plate member 20 are substantially flush with the ceiling 2 in the first state. This configuration improves design since the blow-out unit 100 is inconspicuous even when being mounted to the ceiling 2.

(9-4)

The blow-out unit 100 according to the second embodiments also includes the chamber box 30 defining a part of the air flow path S. The chamber box 30 is placed on the attic or behind the sidewall. The chamber box 30 includes the first wall surface 30*a* located near the first plate member 10, and the second wall surface 30*b* located near the second plate member 20. The chamber box 30 has the opening serving as the blow-out port P. In the opening, the first plate member 10 and the second plate member 20 are placed.

(9-5)

In the first state, the first plate member 10 is flush with the second plate member 20, so that the blow-out port P is closed. In other words, the first side 11*a* of the first plate member 10 is parallel with the first side 21*a* of the second plate member 20. In addition, there is a small gap between the first side 11*a* of the first plate member 10 and the first side 21*a* of the second plate member 20.

Therefore, the blow-out port P can be opened and closed by switching between the first state and the second state of each of the first plate member 10 and the second plate member 20.

(9-6)

The blow-out unit 100 according to the second embodiments also includes the control unit 40, the first motor 41, and the second motor 42.

The first motor 41 allows the first plate member 10 to turn. The second motor 42 allows the second plate member 20 to turn. The control unit 40 is configured to control the first motor 41 and the second motor 42. The control unit 40 controls the first motor 41 and the second motor 42 to respectively adjust the first plate member 10 and the second plate member 20 to appropriate angles. The control unit 40 thus controls the air flow direction and blow distance D1 of air.

(10) Modifications (10-1) Modification 2A

A blow-out unit according to Modification 2A is equal in configuration to the blow-out unit 100 according to the second embodiments except that the blow-out unit according to Modification 2A does not include the motor and the control unit each described in the second embodiments. In the blow-out unit 100 according to Modification 2A, a turning angle of a first plate member 10 and a turning angle of a second plate member 20 are unchanged under normal circumstances. In changing the turning angles, the turning angles are changed manually.

The blow-out unit according to Modification 2A is used in a situation in which there is no necessity to constantly change an air flow direction.

(10-2) Modification 2B

Figure 17:
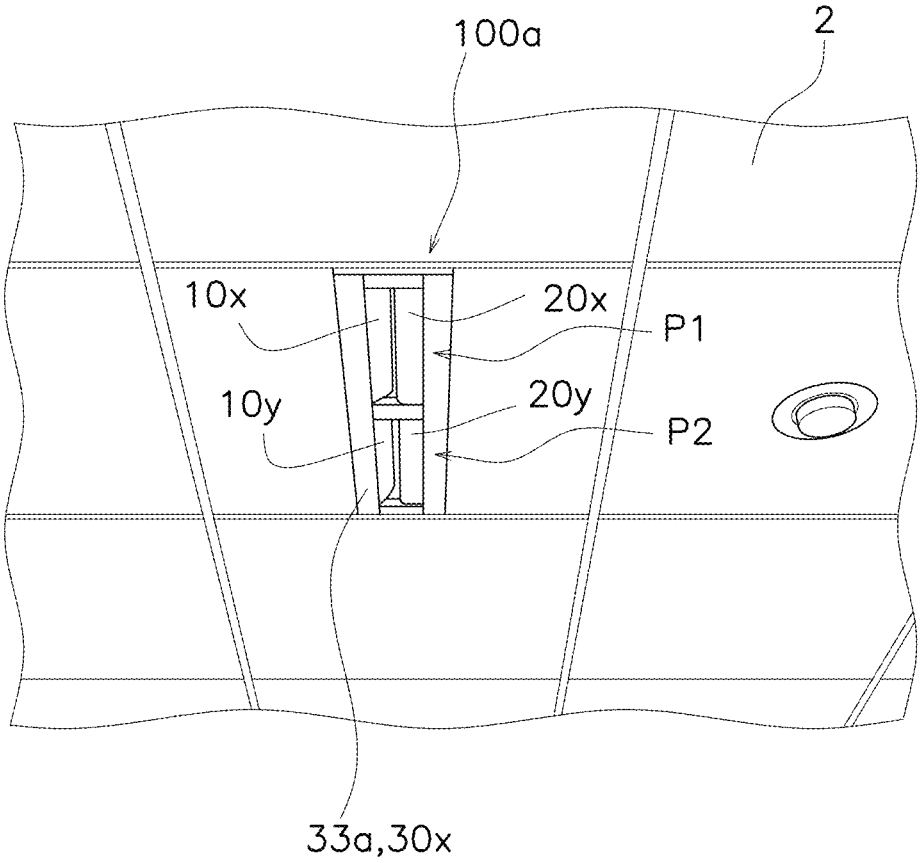
FIG. 17 is a perspective view illustrating a blow-out unit 100*a* according to Modification 2B.

In the blow-out unit 100 according to the second embodiments, air is blown out through the blow-out port P in a single spot between the first plate member 10 and the second plate member 20. According to Modification 2B, air is blown out in two spots. As illustrated in FIG. 17, a blow-out unit 100*a* according to Modification 2B includes first plate members 10*x* and 10*y*, second plate members 20*x* and 20*y*, and a chamber box 30*x* defining a blow-out port P. The first plate members 10*x* and 10*y* and the second plate members 20*x* and 20*y* are placed in the blow-out port P. The first plate member 10*x* is juxtaposed to the second plate member 20*x* in a direction perpendicular to the longitudinal direction of the blow-out port P. The first plate member 10*y* is juxtaposed to the second plate member 20*y* in a direction perpendicular to the longitudinal direction of the blow-out port P. The first plate member 10*x* is juxtaposed to the first plate member 10*y* in the longitudinal direction of the blow-out port P. The second plate member 20*x* is juxtaposed to the second plate member 20*y* in the longitudinal direction of the blow-out port P. A first blow-out port P1 through which air is blown out is defined between the first plate member 10*x* and the second plate member 20*x*. A second blow-out port P2 through which air is blown out is defined between the first plate member 10*y* and the second plate member 20*y*. The first plate members 10*x* and 10*y* and the second plate members 20*x* and 20*y* are similar in configuration and movement to the first plate member 10 and the second plate member 20 described in the second embodiments.

A panel 33*a* includes a portion located between the first plate member 10*x* and the second plate member 20*x* and a portion located between the first plate member 10*y* and the second plate member 20*y*. These portions extend in a direction perpendicular to the longitudinal direction of the blow-out port P. The blow-out unit 100*a* is equal in configuration to the blow-out unit 100 according to the second embodiments except the configuration described above.

In the blow-out unit 100*a* according to Modification 2B, an air flow direction and a blow distance D1 of air to be blown out through the first blow-out port P1 are controllable by controlling a turning angle of the first plate member 10*x* and a turning angle of the second plate member 20*x*. Likewise, an air flow direction and a blow distance D1 of air to be blown out through the second blow-out port P2 are controllable by controlling a turning angle of the first plate member 10*y* and a turning angle of the second plate member 20*y*.

The air flow direction and blow distance D1 of air to be blown out through the first blow-out port P1 are controllable to be substantially identical with the air flow direction and blow distance D1 of air to be blown out through the second blow-out port P2, in such a manner that the turning angle of the first plate member 10*x* is controlled to be identical with the turning angle of the first plate member 10*y* while the turning angle of the second plate member 20*x* is controlled to be identical with the turning angle of the second plate member 20*y*.

In addition, the air flow direction and blow distance D1 of air to be blown out through the first blow-out port P1 are controllable to be different from the air flow direction and blow distance D1 of air to be blown out through the second blow-out port P2, in such a manner that one of or both the turning angles of the first plate member 10*x* and first plate member 10*y* and the turning angles of the second plate member 20*x* and second plate member 20*y* are made different from each other.

In FIG. 17, a ceiling 2, the panel 33*a*, the first plate members 10*x* and 10*y*, and surfaces, each of which fronts onto the room, of the second plate members 20*x* and 20*y* are substantially flush with each other. This configuration ensures excellent appearance of the blow-out unit 100*a*.

(10-3) Modification 2C

In the blow-out unit 100 according to the second embodiments, the first rotating shaft 15 of the first plate member 10 may be provided separately from the first plate member 10, and the second rotating shaft 25 of the second plate member 20 may be provided separately from the second plate member 20. The first rotating shaft 15 is not necessarily located between a plane which is an extension of the first surface 101 of the first plate member 10 and a plane which is an extension of the second surface 102 of the first plate member 10. The second rotating shaft 25 is not necessarily located between a plane which is an extension of the first surface 201 of the second plate member 20 and a plane which is an extension of the second surface 202 of the second plate member 20.

Figure 18:
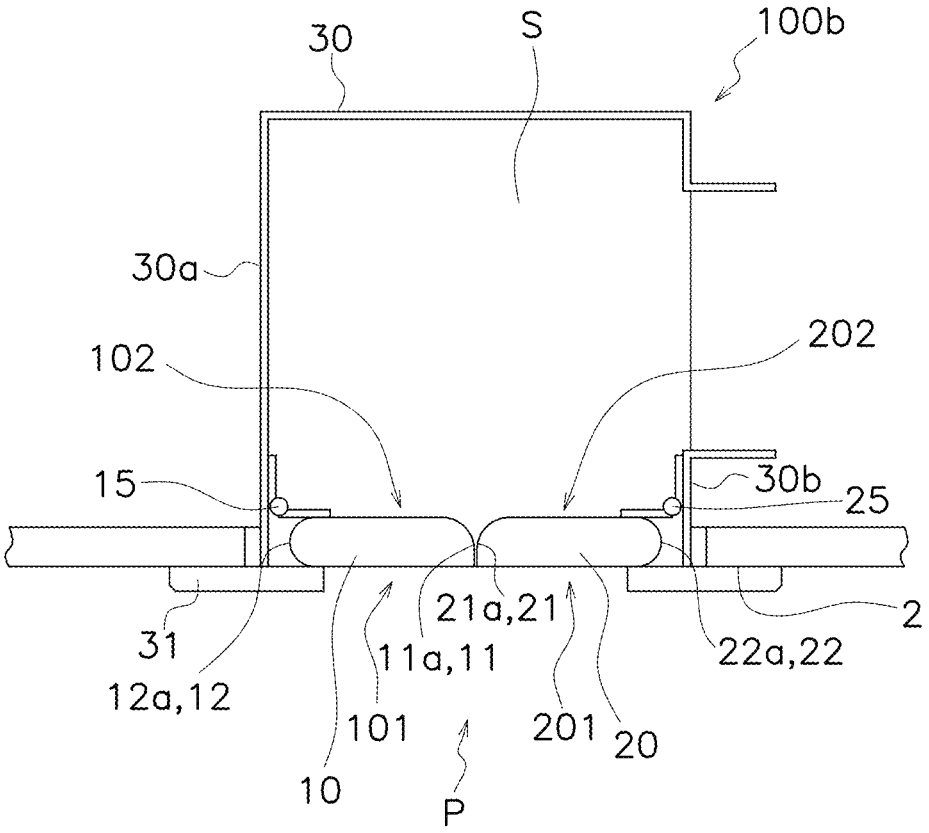
FIG. 18 is a perspective view illustrating a blow-out unit 100*b* according to Modification 2C.

As illustrated in FIG. 18, a blow-out unit 100*b* according to Modification 2C is equal in configuration to the blow-out unit 100 according to the second embodiments except that a first rotating shaft 15 is provided separately from a first plate member 10 and a second rotating shaft 25 is provided separately from a second plate member 20.

In the example of FIG. 18 (a sectional view), in the blow-out unit 100*b* according to Modification 2C, the first plate member 10 includes a first end 11 on a first side, and a second end 12 facing a first wall surface 30*a* of an air flow path S. A rotating fitting is fixed to the first plate member 10 and the first wall surface 30*a*. The rotating fitting includes a first rotating shaft 15 on which the first plate member 10 turns. The second plate member 20 includes a first end 21 on a first side, and a second end 22 facing a second wall surface 30*b* of the air flow path S. A rotating fitting is fixed to the second plate member 20 and the second wall surface 30*b*. The rotating fitting includes a second rotating shaft 25 on which the second plate member 20 turns. Each of the first rotating shaft 15 of the rotating fitting and the second rotating shaft 25 of the rotating fitting is rotatable by a motor or manually.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1, 1*a*, 1*c*, 1*d*, 100, 100*a*: blow-out unit
2: ceiling
3: room
10, 10*x*, 10*y*: first plate member
11*a*: first side of first plate member
12*a*: second side of first plate member
11: first end of first plate member
12: second end of first plate member
101: first surface of first plate member
102: second surface of first plate member
15: first rotating shaft
20, 20*x*, 20*y*: second plate member
21*a*: first side of second plate member
22*a*: second side of second plate member
21: first end of second plate member
22: second end of second plate member
201: first surface of second plate member
202: second surface of second plate member
25: second rotating shaft
200, 200*a*, 200*b*, 200*p*: guide portion
210: first surface
30: chamber box
30*a*, 31: first wall surface
30*b*, 32: second wall surface
33, 33*a*: panel below (chamber box)
P, P1, P2: blow-out port
S: air flow path
F1: first air flow direction
F21, F22: second air flow direction
L: length of plate member
D: thickness of plate member
D1: blow distance
W: width of air flow path (length of blow-out port)
W—L: width of guide portion

PATENT LITERATURE

Patent Literature 1: JP 2007-155309 A

What is claimed is:

1. A blow-out unit disposed at a blow-out port on an air flow path and configured to blow out air supplied through the air flow path, toward a room, the blow-out unit comprising:

a plate member disposed in the blow-out port on one side of the air flow path, having a side, and configured to turn around a rotating shaft disposed away from the side such that the side moves away from the blow-out port toward the air flow path; and a guide portion fixed in the blow-out port on an opposite side of the air flow path to the plate member and extending along the side of the plate member, wherein the guide portion having a surface inclined downward toward the side of the plate member, the plate member and the surface of the guide portion change a direction of air to be blown out toward the blow-out port through the air flow path from a first air flow direction to a second air flow direction, the plate member changes the second air flow direction by turning about the rotating shaft, and in a state in which the side of the plate member is on the blow-out port and viewed in a section taken along a direction perpendicular to the blow-out port and from the plate member to the guide portion, the plate member has a second end that is different from a first end of the side and that abuts on a first wall surface of the air flow path, and the rotating shaft is disposed between the first wall surface and a straight line passing a point away from the second end by one-third of a length of the plate member and extending perpendicularly to the blow-out port.

2. The blow-out unit according to claim 1, wherein the plate member comprises the rotating shaft, and the rotating shaft is disposed near the second end.

3. The blow-out unit according to claim 1, wherein the surface of the guide portion is inclined such that air flowing in the first air flow direction collides with the surface of the guide portion.

4. The blow-out unit according to claim 1, wherein the surface of the guide portion is inclined within an angular range from 20° or more to 65° or less with respect to the first air flow direction.

5. The blow-out unit according to claim 1, wherein $W/4<L<W/2$, where

L is a length between the first end and the second end of the plate member, and

W is a length of the blow-out port in a direction from the first end to the second end.

6. The blow-out unit according to claim 1, further comprising:

a chamber box defining a part of the air flow path, wherein the chamber box is disposed on an attic or behind a sidewall and has an opening as the blow- out port.

7. The blow-out unit according to claim 1, further comprising:

a control unit that controls a turning angle of the plate member, wherein the control unit controls the turning angle of the plate member to change the second air flow direction.

8. An air conditioning apparatus for supplying conditioned air to a room through an air flow path, the air conditioning apparatus comprising:

the blow-out unit according to claim 1 disposed at the blow-out port of the air flow path through which air is blown out toward the room.

9. A blow-out unit disposed at a blow-out port on an air flow path and configured to blow out air supplied through the air flow path, toward a room, the blow-out unit comprising:

a first plate member disposed in the blow-out port and having a side and configured to turn around a first rotating shaft disposed away from the side such that the side moves away from the blow-out port toward the air flow path; and a second plate member disposed in the blow-out port at a different position from the first plate member and extending along the side of the first plate member, wherein the second plate member having a side and configured to turn around a second rotating shaft disposed away from the side of the second plate member such that the side of the second plate member moves away from the blow-out port toward the air flow path, the first plate member and the second plate member change a direction of air to be blown out toward the blow-out port through the air flow path from a first air flow direction to a second air flow direction, the first plate member changes the second air flow direction by turning around the first rotating shaft, the side of the first plate member faces the side of the second plate member in a first state in which the side of the first plate member and the side of the second plate member are co-planar on the blow-out port, and the first plate member and the second plate member are switched between the first state and a second state in which at least one of the side of the first plate member and the side of the second plate member is on the air flow path.

10. The blow-out unit according to claim 9, wherein in the first state, when viewed in a section taken along a direction perpendicular to the blow-out port and from the first plate member to the second plate member, the first plate member has a second end that is different from a first end of the side of the first plate member and that abuts on a first wall surface of the air flow path, the first rotating shaft is disposed between the first wall surface and a straight line passing a point away from the second end of the first plate member by one-third of a length of the first plate member and extending perpendicularly to the blow-out port, the second plate member has a second end that is different from a first end of the side of the second plate member and abuts on a second wall surface of the air flow path different from the first wall surface, and the second rotating shaft is disposed between the second wall surface and a straight line passing a point away from the second end of the second plate member by one-third of a length of the second plate member and extending perpendicularly to the blow-out port.

11. The blow-out unit according to claim 10, wherein the first plate member comprises the first rotating shaft, the first rotating shaft is disposed near the second end of the first plate member, the second plate member comprises the second rotating shaft, and the second rotating shaft is disposed near the second end of the second plate member.

12. The blow-out unit according to claim 9, further comprising:

a chamber box defining a part of the air flow path, wherein the chamber box is disposed on an attic or behind a sidewall and has an opening as the blow-out port.

13. The blow-out unit according to claim 9, wherein, in the first state, the first plate member is flush with the second plate member and the blow-out port is closed.

14. The blow-out unit according to claim 9, further comprising a control unit that brings each of the first plate member and the second plate member into the first state or the second state.

15. The blow-out unit according to claim 14, wherein the control unit controls a turning angle of the first plate member and a turning angle of the second plate member independently of each other, and the control unit changes an air blow-out direction with the turning angle of the first plate member and the turning angle of the second plate member.

16. An air conditioning apparatus for supplying conditioned air to a room through an air flow path, the air conditioning apparatus comprising:

the blow-out unit according to claim 9 disposed at the blow-out port of the air flow path through which air is blown out toward the room.

* * * * *